United States Patent [19]

Mayer

[11] 4,449,507

[45] May 22, 1984

[54] DUAL PRESSURE METERING FOR DISTRIBUTOR PUMPS

[75] Inventor: Endre A. Mayer, Birmingham, Mich.

[73] Assignee: The Bendix Corporation, Southfield, Mich.

[21] Appl. No.: 217,312

[22] Filed: Dec. 17, 1980

[51] Int. Cl.[3] ..... F02B 3/00; F02M 59/42

[52] U.S. Cl. ..... 123/467; 123/446; 123/458; 123/501

[58] Field of Search ..... 123/450, 458, 497, 499, 123/500, 501, 502, 506, 467, 446, 447; 239/89, 90, 91, 92, 533.1–533.12, 93–95

[56] References Cited

U.S. PATENT DOCUMENTS

| | | | |
|---|---|---|---|
| 3,851,635 | 12/1974 | Murtin | 123/478 |
| 3,943,901 | 3/1976 | Takahashi | 123/467 |
| 4,184,459 | 1/1980 | Ishii | 123/467 |
| 4,417,557 | 11/1983 | Walter | 123/446 |
| 4,418,671 | 12/1983 | Kelso et al. | 123/467 |

*Primary Examiner*—Charles J. Myhre
*Assistant Examiner*—Carl Stuart Miller
*Attorney, Agent, or Firm*—Markell Seitzman; Russel C. Wells

[57] ABSTRACT

A fuel injection system for a diesel engine having injection and metering modes of operation for delivering fuel to an engine comprising a plurality of fuel injectors wherein each of said fuel injectors comprise a first port, a second port and a metering chamber for storing a premetered quantity of fuel, during the metering mode of operation, prior to the injection of said premetered quantity of fuel into the engine during the injection mode of operation. The system further includes manifold means for connecting in fluid communication each of second ports of each of said fuel injector, pressure regulating means connected between said manifold means and a fuel reservoir for regulating and for supplying fuel at said second determinable pressure to said second inlet port of each of the injectors and distributor pump means connected to the said first port of each of said fuel injectors and to the fuel reservoir for sequentially pressurizing the first port of a particular injector at a pressure greater than the pressure established by the pressure regulating means causing the piston to stabilize at the bottom of its stroke and sequentially thereafter lowering said first pressure level to a pressure lower than that of the pressure established by said pressure regulating means thereby causing said piston to move causing said premetered quantity of fuel to enter said metering chamber of a particular one of said injectors through said second port and for sequentially thereafter increasing said first pressure level thereby causing said piston to pressurize the fuel within said metering chamber to initiate fuel injection into the engine through a nozzle.

27 Claims, 17 Drawing Figures

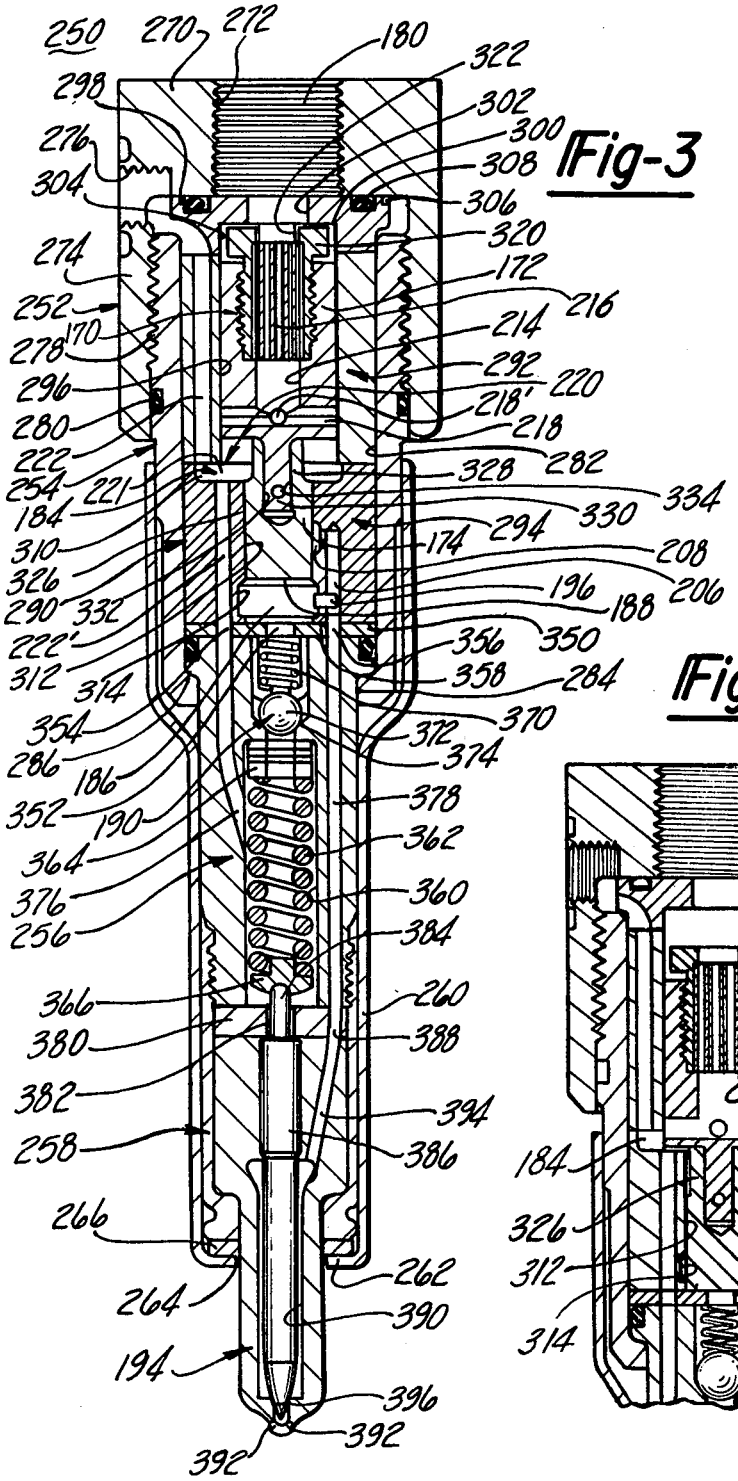
Fig-3
Fig-4
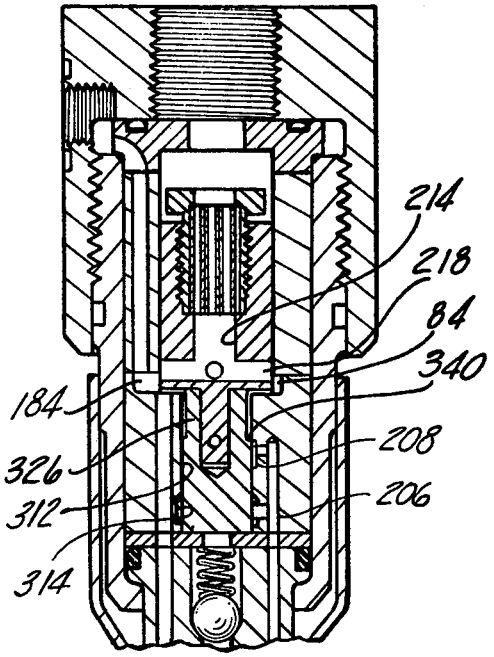

Fig-5
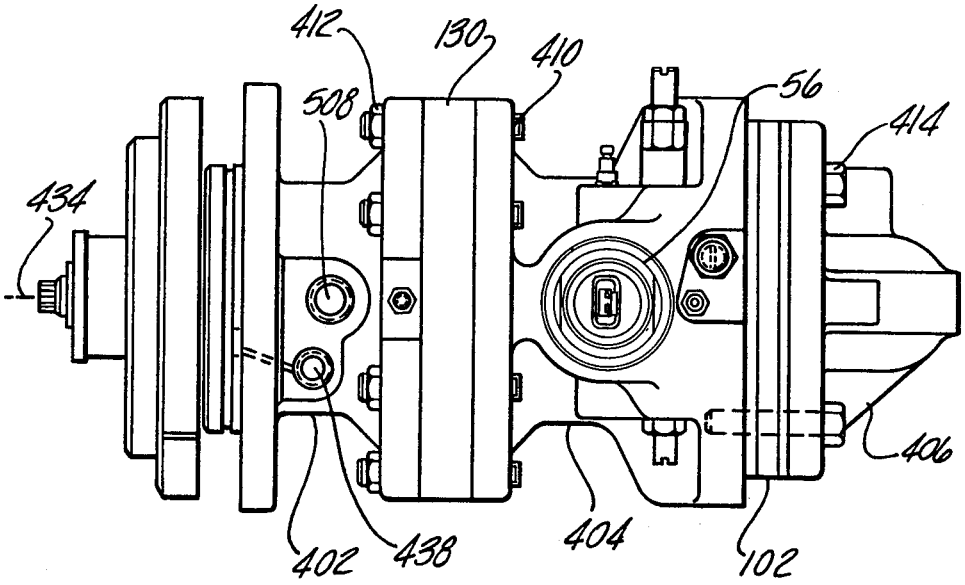
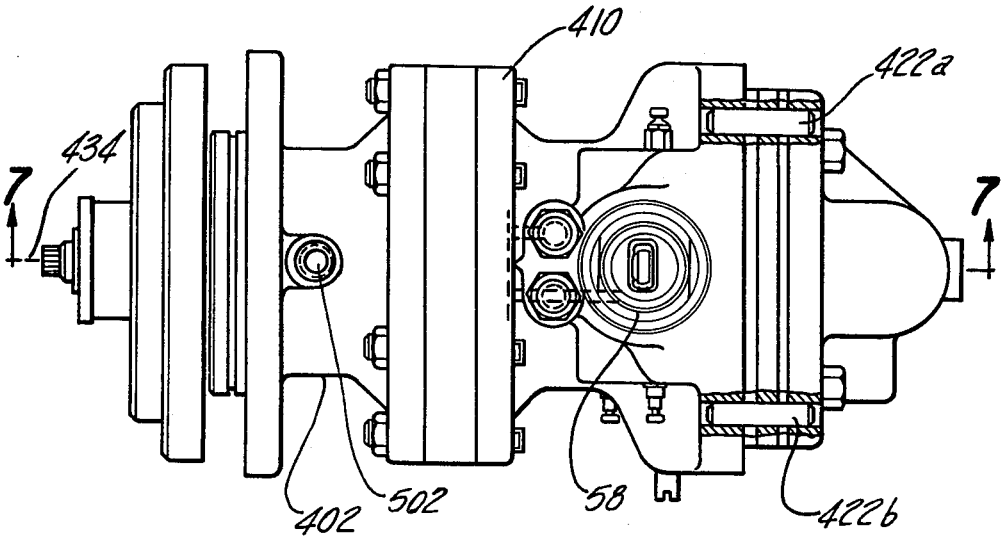
Fig-6

9
9
8
8
11
11
110c
531
533
406
116
62
536a
536b
530
538b
534
542
404
106
102
110a
110b
140
552
572b
570
556
538a
56
166
58
554
152
574
456
132
164
550
496
494
130
514
516
560
558
34
56
450a
512
508
444
504
452
506
432
464
460
430
434
428
438
436
440
504
502
462
402
446
408
416

DUAL PRESSURE METERING FOR DISTRIBUTOR PUMPS

BACKGROUND AND SUMMARY OF THE INVENTION

This invention relates to a fuel delivery system for a diesel engine. More specifically, the invention relates to a fuel system for premetering specific quantities of fuel to a plurality of fuel injectors prior to injection into the engine.

The fuel system disclosed is related to the fuel system disclosed by Walter et al. in the co-pending patent application entitled "A Dual Solenoid Distributor Pump Fuel System". Walter et al. discloses a fuel system for a diesel engine which includes a distributor pump having two solenoids and a pressure activated diesel fuel injector of the type having a metering chamber and intensifier piston located therein. Diesel fuel is communicated to each of the fuel injectors from the distributor pump through individual bi-directional fuel lines. Each fuel injector is also adapted to communicate with a source of pressurized fuel such that this fuel is selectively permitted to flow into the respective metering chambers in correspondence with the selective activation of one of the two solenoid valves. One of the solenoid valves sequentially controls the metering function for all of the injectors while the other solenoid valve sequentially controls the injection timing function, that is a means for pressurizing the fuel within each metering chamber such that this metered quantity of fuel is injected into the engine in correspondence with the combustion process therein. During the period of time that a particular injector is not within its metering event or injection event, the system disclosed by Walter et al maintains the pressure upstream of the intensifier piston as well as the pressure within the metering cavity at approximately the same pressures. During this idle period of time the intensifier piston of Walter et al is subject to unpredictable movement of drift within its injector housing. This drift of the intensifier piston causes errors in metering a quantity of fuel into the combustion chambers of the engine during subsequent metering and injection events.

Fuel delivery systems for diesel engines can be classified into three broad categories. The first category utilizes distributor pumps having a separate fuel supply line for each injector. The second category of fuel delivery system utilizes a constant pressure source in conjunction with a common rail or manifold which communicates the supply pressure to a plurality of diesel fuel injectors. In this second type of the fuel supply system, the injectors are usually of the type having a pressure intensifier. The third category utilizes what is known as a unit injector which incorporates within the injector a pumping element and the control valve.

The first category of systems does not provide sufficient injection timing control as a function of both engine speed and load. If engine timing is mechanically or hydraulically controlled, this type of system is often inflexible and does not display cycle-to-cycle or cylinder-to-cylinder adaptability for controlling the quantity of fuel injected and its related timing. In addition, high injection pressures such as pressures in the vicinity of 10,000 to 14,000 psi are limited mainly by the strength of the long lines between the pump mechanisms and the injectors. In addition, these types of fuel delivery systems falling within the first category display line cavitation and secondary injections and exhibit a relatively slow termination of injection of fuel into the respective cylinders. Secondary injection and slow termination are primarily a result of poor control of the line dynamics.

The second type of system is amenable to electrically controlling both the injected quantity of fuel and the timing of injection. In addition, the constant pressure—common rail system is capable of delivering relatively high injection pressures. However, this type of system is often extremely expensive and is of a relatively bulky size. The expense and size of the system may be attributable to the fact that the constant pressure source utilizes a pressure regulating device in addition to a number of fuel accumulators, as well as using a 3-way valve which is often required to operate against the high pressure supply. A disadvantage of these systems is high leakage caused by the constant high pressure which is transmitted to each of the fuel injectors.

The unit injector fuel systems provide all of the fuel controls in a single package. However, a significant disadvantage of the unit injector is that the diesel engine must be modified or supplied with separate crankshaft, rocker arms and followers to drive the pumping element of the unit injector. This forecloses the use of the unit injector on standard diesel engines absent a significant redesign or modification of the engine. In addition, since each unit injector must be provided with a control valve the packaging or placement of the injector into the engine or cylinder head is more difficult when compared to the placement and packaging of smaller pressure activated injector valves as utilized by the present invention.

To meet future diesel fuel injection system operating requirements as to fuel economy and emissions control requires high performance. These performance requirements include: (a) high injection pressure of 15,000 psi or more; (b) that the injection system be capable of independent timing and metering control as a function of engine speed and load; (c) that the fuel system be able of controlling its cooperating fuel injector to display injection rate control and display an abrupt termination of fuel injection; (d) that the fuel injection system offer cycle-to-cycle and cylinder-to-cylinder adaptive control; (e) that the fuel injection system can be adapted to standard diesel engines requiring minimum engine change; (f) that the fuel injection system be of low cost and (g) that the fuel injection system display low power input, minimum power drain and low heat buildup.

The above requirements are met by the present invention which broadly includes a dual solenoid distributor pump that is connected individually to a plurality of diesel fuel injectors by bi-directional fuel flow lines. The timing of injection and the quantity of metered fuel delivered to each fuel injector is controlled both on a cycle-to-cycle and cylinder-to-cylinder basis using microprocessor technology by adjusting the electrical signals to two solenoids located within the dual solenoid distributor pump. The drift of the intensifier piston is controlled by incorporating within a distribution valve (of the pump) a distribution slot which is connected to a determinable pressure such that the pressure force so created to communicated in advance of each metering event to the intensifier piston of a particular injector to force that piston to remain at the bottom of its stroke.

An advantage of the present invention is that it may be configured to be packaged and adapted to all sizes of diesel engines with virtually no engine modification. The system utilizes a relatively inexpensive pump in combination with an injector which has a metering chamber. The fuel injection system provides the following advantages: (1) fuel metering is performed at the injector; (2) the injector is provided with a secondary dump port to abruptly end fuel injection; and (3) by utilizing an injector having an intensifier piston therein high pressure lines connected to the pump and injector are eliminated, each injector requires only a single bi-directional injection line and a single low pressure line for fuel metering.

The injector includes an intensifying piston which receives a pressure pulse as a result of the controlled excitation of the timing solenoid valve. The combined features of the distributor pump and injector result in the delivery of fluid at high injection pressures (10,000 to 25,000 psi).

The injector is also provided with a primary dump port and a laminer flow restrictor which functions to depressurize the injection line linking the distributor pump to the intensifier piston, thus preventing line cavitation and secondary fuel injection. This results from incorporating within the distributor pump a positive displacement pump. By utilizing only two valves to control both engine timing and fuel metering, the number of control and timing valves which are found in the prior art are minimized. In addition, by incorporating the control and timing features into the dual solenoid distributor pump permits the relocation of this timing and metering controller away from the limited space near the engine or cylinder head area.

According to the specific embodiments illustrated in the drawings of this application and discussed in detail below, the present invention comprises:

A fuel injection system for a diesel engine having injection and metering modes of operation for delivering fuel from a fuel reservoir to the cylinders of an engine comprising: a plurality of fuel injectors wherein each of the fuel injectors comprise: a housing having a first port adapted to receive fuel at a first determinable pressure level, a second port adapted to receive fuel at a second determinable pressure level and a nozzle, and further having metering chamber means connected to the second port, for storing a premetered quantity of fuel, during the metering mode of operation, prior to the injection of the premetered quantity of fuel into the engine during the injection mode of operation. Each injector further includes piston means reponsive to the differential fuel pressure applied thereacross having a first pressure receiving surface in fluid communication with the first port and a second pressure receiving surface in fluid communication with the second port for reciprocatively moving within the housing for selectively compressing and for causing premetered quantity of fuel to exit the metering chamber means and to be injected into the engine, through the nozzle, during the injection mode and for selectively permitting fuel to reenter the metering chamber means during a subsequent metering mode.

The system further includes manifold means for connecting in fluid communication each of second ports of each fuel injector and pressure regulating means connected between the manifold means and the fuel reservoir for regulating and for supplying fuel at the second determinable pressure to the second inlet port of each of the injectors and for returning to the reservoir excess fuel received from the injectors and distributor pump means connected to the first port of each fuel injector and to the fuel reservoir for sequentially pressurizing the first port of a particular fuel injector at a pressure greater than the pressure established by the pressure regulating means thereby causing the piston to stabilize at the bottom of its stroke and for sequentially thereafter lowering the first pressure level to a pressure lower than that of the pressure established by the pressure regulating means thereby causing the piston to move causing the premetered quantity of fuel to enter the metering chamber of a particular one of the injectors through the second port and for sequentially thereafter increasing the first pressure level thereby causing the piston to pressurize the fuel within the metering chamber to initiate fuel injection into the engine through the nozzle.

BRIEF DESCRIPTION OF THE DRAWINGS

FIG. 3 is a cross-sectional view of a diesel injector.

FIG. 4 is a partial cross-section view of the diesel injector of FIG. 3 illustrating the injector piston at the end of its compression stroke.

FIG. 5 is a top view of a dual solenoid distributor pump.

FIG. 6 is a bottom view of the distributor pump.

DETAILED DESCRIPTION OF THE DRAWINGS

Figure 1:
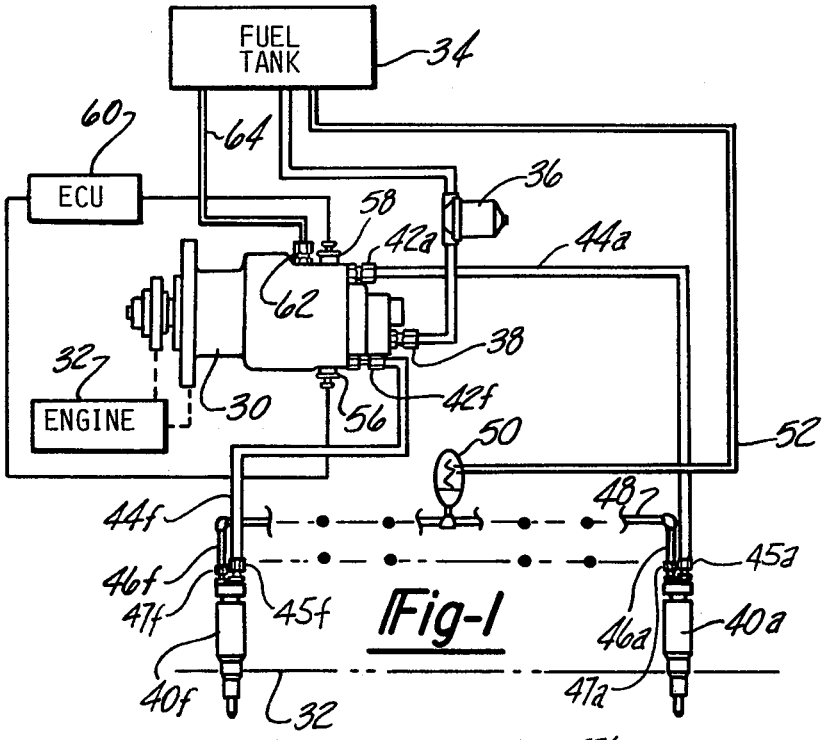
FIG. 1 diagramatically illustrates the main elements of a fuel injection system incorporating the present invention.

Reference is now made to FIG. 1 which illustrates the interconnection between a number of the components of an electrically controlled fuel injection system for diesel engines. More specifically, there is shown a dual solenoid distributor pump 30 adapted at one end to be driven by the diesel engine 32. The distributor pump 30 is connected to a liquid reservoir such as the fuel tank 34 through a fuel filter 36. Fuel is received at the input port 38. The distributor pump 30 is further adapted to communicate with a plurality of injectors 40*a–f* through output ports 42*a–f*. While the distributor pump 30 is shown communicating with six diesel injection valves, it should be understood that the invention may be adapted to communicate with any number of injectors. Each injector 40 is adapted to connect with and receive fuel through one of the bi-direction injection lines 44*a–f* through a first port 45. Each injector has a second port 47 which is adapted to connect to a particular accumulator or pressure line 46*a–f* which each connected to a manifold or common line 48. The manifold 48 is connected to a low pressure accumulator 50 which may also include a relief valve (not shown). The output of the accumulator is connected via the pressure return line 52 to the reservoir or fuel tank 34.

The distributor pump 30 further includes a first or timing valve 58 and a second or metering valve 56 which are adapted to communicate with an electronic controlled unit or ECU 60 of a known variety. The distributor pump 30 further includes an additional output port 62 which returns fluid to the fuel tank 34 via the return line 64.

Figure 2:
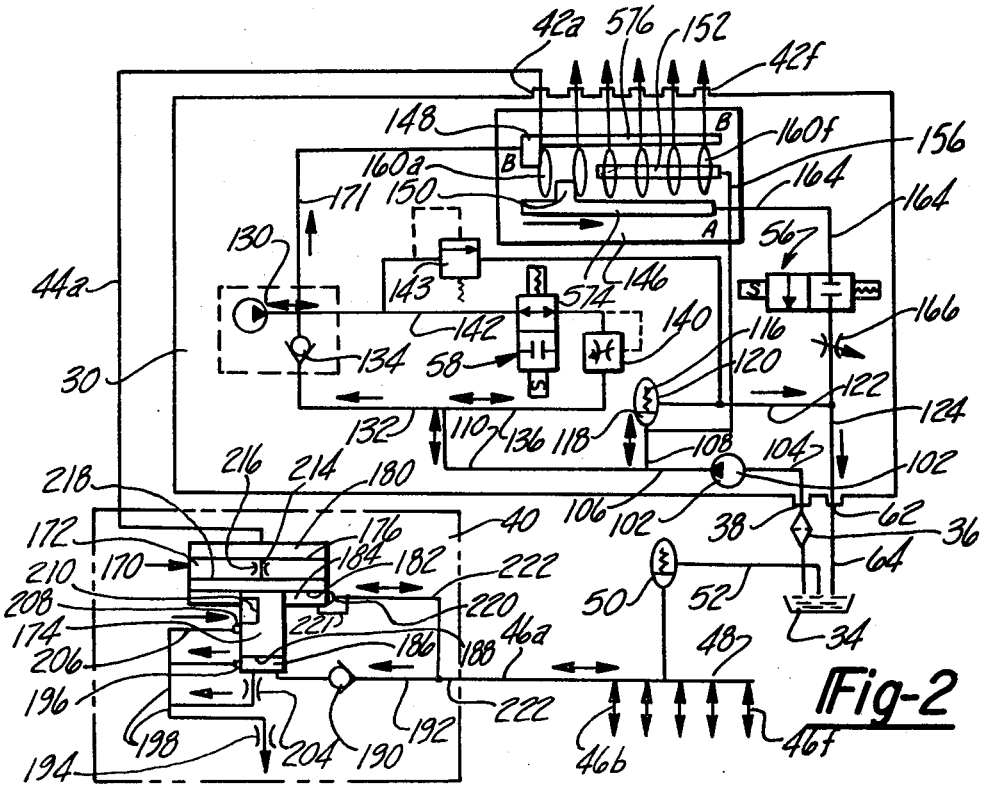
FIG. 2 is a hydraulic schematic diagram illustrating the hydraulic connections between a number of the major components of the present invention.

The operation of the fuel system, the distributor pump 30 and the fuel injectors 40, is best understood in conjunction with the detailed description of the hydraulic schematic diagram illustrated in FIG. 2.

Reference is now made to FIG. 2, which illustrates a detailed hydraulic schematic diagram of the major components of the fuel delivery system which has been diagrammatically illustrated in FIG. 1 and shown in detail in FIGS. 3–14. There is generally illustrated the fuel tank 34 communicating with the distributor pump 30 through the fuel filter 36. The distributor pump in turn is illustrated communicating via the output ports 42*a–f* to the fuel injectors 40*a–f*. Inasmuch as the communication and operation of the distributor pump 30 with respect to each of the fuel injectors 40*a–f* is identical, the following description is directed to the interrelationship between the distributor pump 30 and one of the fuel injectors 40*a–f*. In addition, where appropriate, the letters a–f will not be included in the following discussion.

Reference is again made to the more detailed embodiment of the distributor pump 30 as illustrated schematically in FIG. 2. More specifically, the input port 38, which is maintained in fluid communication with the fuel filter 36, is connected to the input of a transfer pump 102 through an internal fluid passage 104. Those skilled in the art will appreciate that the fluid passage 104 and the other similar fluid passages within the distributor pump 30 are actually channels fabricated within the housing or other members of the distributor pump 30. For purposes of illustration, however, these fluid communication passages will be called, in conjunction with the explanation of FIG. 2, pressure lines or fluid passages. The output of the transfer pump 102 is connected via another fluid passage 106 to the bidirectional pressure lines or passages 108 and 110. The pressure line 108 is connected to an accumulator 116 having a storage chamber 118 and a relief valve 120. The output of the accumulator 116 is connected via a pressure line 122 to a pressure line 124 which is connected to the pump output port 62. As will be seen in connection with the detailed description of the pump 30, the pressure lines 122 and 124 comprise any number of internal fluid passages which transmit fluid through the pump housing for cooling, lubrication and air purging.

In the present embodiment, the transfer pump 102 which may be a conventional gear pump is maintained at a relatively low pressure, approximately 200 psi, as a result of the interaction with the accumulator 116. The accumulator 116 functions to regulate the pressure at the output of the transfer pump 102 by storing fuel during low flow demand periods and by delivering fuel during high flow demand periods. After the accumulator chamber 118 is filled, the relief valve 120 will permit the flow of excess fluid from the transfer pump 102 to the fuel tank 34 through the pressure line 122.

The transfer pump 102 is used to fill an injection pump 130. The fluid is supplied to the injection pump through the pressure line 110 which is connected to the unidirectional pressure line 132 which is, in turn, connected to check valve 134 which is located within the injection pump 130. In the preferred embodiment, the injection pump 130 is a continuous displacement cam driven piston pump. The transfer pump 102 is also connected to the injection pump 130 through the bidirectional pressure line 136 which communicates with pressure line 110 and to a variable orifice back pressure or check valve 140. The other end of the variable orifice 140 is connected to the injection pump 130 via the timing valve 58. The timing valve 58 is connected to the injection pump 130 through the pressure line 142. Because of the line restrictions provided by the orifice 140 and the timing valve 58, a negligable portion of the injection pumps fluid requirements will be supplied through pressure line 142. In addition, while not a requirement of the invention, a relief valve 143 may be connected between the pressure line 142 and the output port 62. The relief valve 143 functions to prohibit the build-up of excessive fluid pressures within the distributor pump 30.

As previously mentioned, a feature of the present invention is the utilization of a single solenoid valve for timing and another solenoid valve for metering. Inasmuch as the fuel injection system may be configured with any number of fuel injectors, it is necessary to distribute the output of the injection pump 30 to the appropriate injectors 40*a–f*. This is accomplished by utilizing the distributor valve 146. The distributor valve comprises three distribution slots 148, 150 152 which are selectively placed into communication with a plurality of openings 160*a–f*. The openings are maintained in fluid communication with the respective output ports 42*a–f* of the distributor pump. As described in detail below, in conjunction with FIGS. 7–13, the openings 160*a–f* are circumferentially positioned in a fixed, hollow sleeve and the distribution slots 148 and 150 comprise annular recesses situated in a shaft member which rotates within the fixed sleeve. For purposes of the present discussion relative to FIG. 2, however, the distribution slots 148 and 150 are shown as having translational movement relative to the openings 160*a–f*. More specifically, the distribution slot 148 is connected to the injection pump via the pressure line 171. As illustrated in FIG. 2, the distribution slot 148 is in communication with opening 160*a* which permits the injection pump to be connected via the injection line 44*a* to the injector 40*a* therein delivering pressurized fluid or fuel thereto. As the distribution slot 148 is moved to the right, the injection pump is maintained in selective communication with each of the other fuel injectors 40*b–f* through the remaining openings 160*b–f*. During the period of time that the timing valve 58 is open, the fluid in pressure lines 142,171 and in the distributor slot 148 and one of the injection lines 44 is maintained substantially at the pressure of the injection pump which may nominally be in the vicinity of 200 psi. With the timing valve 58 in an open condition, the flow from the injection pump 130 is primarily dumped to a low pressure supply, i.e., the accumulator 116, through the bi-directional pressure lines 142, 136, 110 and 108.

To initiate fuel injection the timing valve 58 is closed in response to timing signals generated by the ECU 60 and the total output of the injection pump is diverted through the distribution slot 148 to a specific fuel injector 40. After the timing valve is closed, the fluid within the pressure line 171, the distribution slot 148 and a specific injection line 44, is compressed by the action of the injection pump and a pressure pulse is transmitted through these lines thereby activating an injector and causing a determinable quantity of fuel that was previously stored or premetered in the injector to be injected into the engine.

Reference is again made to the distribution slot 150 of the distributor valve 146. The distribution slot 150 is situated relative to the distribution slot 148 such that it leads the motion of the distribution slot 148. This is necessary since a metered quantity of fuel must first be placed within a particular injector 40 prior to the time that a pressure pulse is developed by the injection pump 130 due to the closing of the timing valve 58. The amount or degree of lead is a variable depending upon the application of the invention.

The distribution slot 150 is connected via the fluid passage 164 to the metering valve 56 which is in turn connected to the output port 62 through the variable area orifice 166 and the internal fluid passage 124.

Reference is again made to the distribution slot 152 which is part of the distributor valve 146. The distribution slot 152 comprises internal fluid passages located within the distributor valve 146. The distribution slot 152 is connected via the fluid passage 154 to a source of pressure such as the regulated output of the transfer pump 102. In operation, the distribution slot 152 leads the motion of the distribution slot 150. This is necessary since it is required that a positive pressure be input through particular openings 160 forcing a particular piston 170 to the bottom of its travel prior to the time that the distribution slot 150 comes in contact with that particular opening thus beginning the metering event. As illustrated schematically in FIG. 2, the distribution slot 152 is shown simultaneously communicating with all of those openings 160*c–f* which are not in contact with either the distribution slots 148 or 150. As shall be illustrated below it is not a requirement for the distribution slot 152 to simultaneously communicate with all of the idle openings 160*c–f*. The distribution slot 152 must, of course, communicate with at least that particular opening 160 which is immediately forward of the distribution slot 150. In addition, the distribution slot 152 may be shaped, as illustrated by the dotted line, in a known manner to develop the gradual buildup of pressure through the injection lines 44.

The sequence of metering, the timing of injection and the elimination of piston drift performed by the distributor valve 146 is as follows: Upon the closing of the normally open timing valve 58 in correspondence with the combustion processes within the engine 32 pressurized fuel is transmitted to a first injector, such as injector 40*a*, which had previously been charged with a metered quantity of fuel, thus causing the metered quantity of fuel to be injected into the engine. During the interval of time that the distribution pump 30 is developing a high pressure to cause fluid within injector 40*a* to be injected, the distribution pump also communicates, via the distribution slot 150, with the next injector in the firing sequence therein charging this next injector, such as injector 40*b*, with a metered quantity of fuel. In addition, during this interval of time, the transfer pump communicates with the injector 40*c* through the distribution slot 152 such that the corresponding piston 170*c* of injector 40*c* is forced to remain at the bottom of its stroke. As each of the distribution slots 148, 150 and 152 proceed to the right, the injection pump 130 will be connected to injector 40*b* through the distribution slot 148, the opening 160*b* and the injection line 44*b*. During this period of time the distribution slot 150 is placed in communication with a subsequent injector, such as the injector 40*c*, through the interaction with the opening 160*c*. In addition, during this subsequent period of time, the distribution slot 152 is placed in communication with a subsequent injector such as injector 40*d* through the interaction of the opening 140*d* and the injection line 44*d*, thus preparing this subsequent injector (40*d*) for a subsequent metering event or cycle.

As will be discussed in detail below, the metering function also permits the controlled depressurization of the injection lines 44 by selectively venting to the fuel tank 34 each injector 40, thus permitting fluid to flow from a specified injector through its cooperating injection line 44 into the distribution slot 150, through the metering valve 56 through the pressure lines 124 and 164 to the fuel tank 34.

Reference is now made to the hydraulic schematic of injector 40*a* as shown in the lower portion of FIG. 2. Each injector 40 comprises a housing (not shown) having situated therein a reciprocating piston 170 which includes an upper piston member 172 and a lower piston member 174. The upper piston member has a pressure receiving surface 176 which is situated adjacent to an upper pressure receiving chamber 180. The upper piston member 172 further includes a middle surface 182 situated proximate a middle chamber 184. The lower piston member includes at its lower end a lower surface 188 which defines the upper boundary of a variable volume or metering chamber 186. The metering chamber is connected to the pressure line 46 by a check valve 190 and a fluid passage 192. In addition, the metering chamber 186 is connected to a nozzle 194 through a metering port 196 and fluid passages 198 and through a damping orifice 204. In addition, the metering chamber is connected via a fluid passage 206 to a secondary dump port 208. The dump port in turn, is selectively communicated to the middle chamber 184 via a fluid passage 210 fabricated within the lower piston member. Depending upon the position of the piston 170, the fluid passage 206 is either dead ended or connected to the accumulator 50 via the fluid passage 210, the middle chamber 184, the fluid passage 222 and the pressure line 46*a*.

Reference is again made to the upper piston member 172. The upper piston member contains a longitudinal fluid passage 214 having inserted therein a laminar flow restrictor 216. The output of the laminar flow restrictor is connected to a transverse fluid passage 218. As the piston 170 is forced to the bottom of its stroke by the pressure of fluid in the upper chamber 180, the transverse fluid passage 218 will be placed in communication with a primary dump port 220. The dump port 220 is, in turn, connected via a fluid passage 222 to the pressure line 46 and to the accumulator 50.

The operation of the fuel injection system illustrated in FIG. 2 is discussed in greater detail below. As previously mentioned, the distributor pump and more specifically, the transfer pump 102 and the injection pump 130 are driven by the engine. In response to this driving motion, the transfer pump extracts fluid from the fluid reservoir or fuel tank 34. The output pressure of the transfer pump 102 is maintained at a relatively low pressure such as 200 psi by the cooperation of the accumulator 116. It can be seen, therefor, that the pressure in the fluid passages 106, 110, 132, 136 and the pressure within the check valve 140 are maintained at substantially the regulated pressure set by the accumulator 116. The transfer pump 102 and accumulator 116 are sized such that there is adequate flow capability to supply this low pressure fluid to the injection pump 130. After the injection pump 130 is filled, excess accumulator fluid is returned to the reservoir via lines 122 and 124. It can be seen that the pressure within lines 122, 124 and the return line 64 is substantially the pressure of the fuel within the fuel tank. This pressure would normally reside at approximately atmospheric pressure if the reservoir or fuel tank 34 is vented to the atmosphere. In addition, it can be shown that the return or overflow line 52 linking accumulator 50 with the fuel tank will also nominally be maintained at the fuel tank pressure.

The timing valve 58 is normally maintained in an open position during which time the fluid passages 142, 171 and the distribution slot 148 are maintained at the output pressure of the injector pump 130. In addition, one of the lines 44, the upper cavity 180 and the fluid passages 214 and 218 located within a specific injector are also maintained at the injection pump output pressure. It should be recalled that the distribution valve 146 connects the injection pump 130 to only one of the injectors 40*a–f* at any specific time. In addition, it should be noted that excess injection pump flow is returned to the reservoir 34 through the timing valve 58. In response to a timing signal generated by the ECU 60, the timing valve 58 is commanded to close. Upon the closing of the timing valve a pressure wave is generated and transmitted via one of the injection lines 44 such as 44*a* to the injector such as 40*a* presently connected to the distribution slot 148.

As mentioned, the pressure within the fluid passages and pressure lines connected to the injection pump 130 during the intervals of time when the timing valve 58 is open will approximately be maintained at the injection pump pressure which may be about 200 psi plus the pressure differential across the check valve or variable orifice 140. However, upon the closing of the timing valve and the generation of the pressure wave the pressure transmitted to a specific fuel injector may be as high as 7,500–15,000 psi. In response to this increased pressure transmitted to the upper cavity 180, the piston 170 is caused to move downward thereupon urging any fluid that is within the middle chamber 184 to flow therefrom through the fluid passage 222 to the accumulator 50. The fluid that has been metered, by a prior metering event, into the metering chamber 186 is compressed by the piston 170 to a pressure significantly higher than the pressure of the fluid in the upper cavity 180. This increase in pressure is a direct result of the intensification ratio of the piston 170 resulting from the relationship in areas of the pressure receiving surface 176 and the area of the lower surface 188 of the lower piston member 174. Fluid at this substantially higher pressure is caused to flow through the fluid passages 198 and the orifice 204 to the nozzle 194. At some predetermined pressure the nozzle will open permitting fuel or fluid to be injected into a specific cylinder of the diesel engine. The piston 170 will continue its downward motion and injection will continue until the lower piston member 174 places fluid passage 210 in communication with the fluid passage 206 and dump port 208. The opening of the secondary dump port 208 permits the high pressure fuel within the metering chamber 186 and in the fluid passages 198 and 206 to be rapidly dumped through the port 221 to the accumulator 50 thus causing the pressure within the metering chamber 186 to drop therein enhancing the rapid termination of injection. The flow from the pump is no longer required for injection and is also vented through the primary dump port 220. This is accomplished as follows. Motion of piston 170 places the fluid passage 218 in communication with the primary dump port 220 thereby relieving the pressure in the upper chamber 180 and its associated connecting fluid passages or lines such as the injection line 44*a*. The flow through ports 220 and 221 are used to keep the accumulator 50 fuel of fluid which is as the source of metering fund. It should also be noted that the dual dumping of the pressure within the metering chamber 186 and the upper chamber 180 may be simultaneously vented to the primary dump port 220.

It should be appreciated that in the steady state, after each injection event, the pressure within the upper chamber 180 and its corresponding injection lines 44*a–f* will stabilize at the pressure determined by the accumulator 50. It should also be noted that the dual dumping of the pressure within the metering chamber 186 and the upper chamber 180 may be performed sequentially or may be simultaneously vented to port 220.

The laminar flow restrictor 216 insures that the pressure within the injection line 44 and upper cavity 180 decays in a controlled manner. In addition, the laminar flow restrictor minimizes reflected pressure waves in an injection line and insures that the specific injection line is maintained at or near the pressure of the accumulator 50 prior to the next metering interval. The laminar flow restrictor may be sized such that its impedance is matched to the impedance of its respective injection line 44 which may vary from injector to injector.

Since the accumulation pressure is set in the range of 200 to 800 psi, this is very helpful in preventing cavitation. The laiminar flow restrictor is used to controllably decay the pressure. By having the accumulator 116 some negative pressure waves are tolerable without causing cavitation which is a serious cause of line failures. Without the laminar restrictor; the lines 44*a–f* and 46*a–f* would be susceptible to cavitation damage.

During the dumping of the fuel through the dump ports 208 and 220, the fluid flows through the manifold 48 and then into the accumulator 50. The injection pump 130 is sized to supply enough flow through each injector for the purpose of cooling the injectors and for keeping the accumulator 50 filled in order to supply fluid to the metering chamber of each injector 40 during the metering intervals and to insure that there is a constant flow of fluid towards the reservoir or fuel tank 34 to permit adequate cooling and filtering. This eliminates the need for an additional pump to fill the injector during metering.

Immediately upon the termination of an injection event the piston will be positioned at the bottom of its stroke with its respective injection line 44 connected to the low pressure dump port 220. In this position, the pressure immediately above and below the piston 170 will be determined by the accumulator 50. The pressure differential across the piston 170 is substantially zero and the piston should remain in this position until the next metering and injection interval or event. However, because of the substantially zero pressure differential across the piston 170 the piston may exhibit some drift upward prior to a subsequent metering interval or event. This drift may be evident in the commonly assigned patent application of Walter et al. which is expressly incorporated herein by reference. To insure the accuracy of the subsequent metering events for each particular injector 40*a–f*, the piston 170 of that particular injector will be urged downward by the cooperative effort of the fluid pressure from the transfer pump 102 which is distributed to the particular injector through the distribution slot 152.

Prior to each injection event each injector 40*a–f* must be charged with a specific quantity of fuel. In response to an electrical signal generated by the ECU 60, the metering valve 56 is activated and an injector is connected to the metering control valve 56 through one of the openings 160*a–f* in the distributor valve 146. More specifically, a pulse width metering signal is generated by the ECU 60 in correspondence with the passage of the metering slot 150 across a specific one of the openings 160*a–f* within the distributor valve 146. In the preferred embodiment, the metering valve is normally closed. This condition is illustrated schematically in FIG. 2. Consequently, when there is no power or activation signal applied to the metering valve, there will be no fuel metered to the injectors. It should be noted, therefor, that the metering valve serves a dual purpose, that is, first to meter specific quantities of fuel to the injectors and second it functions as a key-shutoff valve, which when closed, prohibits fuel flow to the injectors thus shutting off the engine. It is possible to replace the normally closed metering valve with a metering valve of the type which is normally open. However, the use of the normally closed metering valve is advantageous since, over its duty cycle, it can be shown that the metering valve is energized a minimal amount of time. Hence, the normally closed metering valve utilizes less power than would be used by an equivalent normally open metering valve and does not require a separate key-shutoff valve.

As previously mentioned, each metering event or interval is begun by opening the metering valve 56 in response to the activation signals received from he ECU 60 and ends when the metering valve is closed. The advantage of utilizing a separate valve for metering and another valve for timing permits the metering event to occur separately from that of injection thus isolating the two events. The isolation of these functions permit a greater time for fuel to be metered into a specific fuel injector 40 and improves the overall accuracy of metering. It should be recalled that after the prior injection event, a particular pressure line 44 and the pressures in the upper and middle chambers 180, 184 and the metering chamber 186 of the injector are maintained at the pressure set by the accumulator 50. It can be seen that the pressures in the injection lines 44 and the openings within the distributor slots connected to these injectors, with the exception of the injector which is entering its injection cycle, are maintained at substantially the pressure determined by the accumulator 50. Since the exit port of the orifice 166 (which is located proximate the metering valve 56) is at a pressure which is substantially lower than that of the pressure set by the accumulator 50 upon the opening of the metering valve 56, fluid will flow from the accumulator 50 through a specific injector 40 to the distribution valve 146 and through the metering valve 56 to the fluid reservoir 34. The flow of fluid from the accumulator 50 causes the piston 170 to rise, thus filling the specific metering chamber 186. Fluid will continue to enter the metering chamber 186 until the metering valve 56 is commanded to close; this would correspond to the removal of the activation signals transmitted from the ECU 60.

It can be seen that by knowing the pressure differences across the injectors 40, the metering valve 56 and the orifice 166 and by determining the combined restrictions imposed by the metering valve, the orifice 166 and the injection lines 44 and by the restrictions imposed by the fluid passages within the injector and distribution valve 146, the flow rate of fuel through the metering valve can be determined. Consequently, by monitoring the time that the metering valve is open, the quantity of fuel permitted to flow into the metering chamber can be controlled.

In addition, it can be seen that the laminar flow restrictor 216 is also helpful in controlling the line dynamics when the metering valve 56 is opened. By limiting the pressure thereacross, the laminar flow restrictor prevents line cavitation at the start of metering and more importantly restricts flow from the accumulator 50 from being short circuited by flowing directly from line 222 to line 44 through passages 220, 218, 214 which would not allow the piston 170 to move during metering.

Almost immediately after the metering event is completed, the distributor valve will now connect the injection pump 130 to the injector 40 which has just received its metered quantity of fuel to initiate another injection event or interval as previously described.

As preiously mentioned, it is desirable to isolate the injection events from the metering events. It has been shown that the metering interval is commenced by maintaining a pressure differential across the injector. Consequently, it is necessary to insure that during the injection event or interval that the pressure within the appropriate injection line 44 does not drop below the pressure of the metering chamber 186. If this condition is allowed to occur, the piston 170 will move upward and additional, unnecessary fuel will enter the metering chamber 186. To prevent this unnecessary introduction of fluid into the metering chamber, it is necessary to create either a higher supply pressure, which is determined by the characteristics of the transfer pump 102 and the accumulator 116, or to develop a high pressure from the injection pump.

The injection pump pressure can be shown to be a function of engine speed and the restriction imposed by the timing valve 58. As an example under normal operating conditions, the speed of the injection pump may change by factor of 4, consequently, the output pressure of the injection pump 130 may change by a factor of 16 when the timing valve is open. If the restriction of the timing valve 58 is too small, then at high operating speeds the injection line 44 will be pressurized too soon and premature injection may occur. If, however, the restriction of the timing valve 58 is too small, the pressure of the injection pump 130 prior to the time that the timing valve 58 is closed, may be reduced below that of the pressure within the metering chamber and unwanted metering may occur. The unwanted metering problem can be solved by maintaining the pressure, as previously mentioned, on the injection pump side of the timing valve at an increased pressure or alternatively, the orifice or back-pressure valve 140 may be introduced into the system.

It is contemplated that this back-pressure valve 140 may be of the variety having two area limits. As the injection pump speed increases, that is, as the injection pump pressure similarly increases, the back-pressure valve 140 will open to maintain the injection pump pressure below injection pressure levels. During the lower speed conditions, the back-pressure valve 140 will be maintained at its smaller opening, thus enabling the injection pump 130 to develop a sufficiently high pressure to prevent the unwanted metering of fuel into the metering chamber during the period between the end of metering and start of injection.

It can be seen that by using a distribution pump 30 having two solenoid valves 56 and 58, the metering, timing and engine shutoff features can be readily accomplished. By utilizing a distributor pump which includes a single injection pump 130, permits the injection pump 130 to be sized as a medium output level pressure pump having a peak output pressure of 8,000 psi. In addition, by including within the distributor pump 30 an accumulator, such as accumulator 116, permits the transfer pump 102 and associated filters to be smaller because the instantaneous flow rate, to and from the transfer pump is reduced. In addition, by sizing the orifices within the metering valve 56 and the orifice 166, the rate at which metering occurs can be specified. In addition, it can be seen that the metering and timing function requires only a single bi-directional injection line 44 from the distributor pump 146 to any specific injector and another single low pressure line 46 which is manifolded together. Consequently, there is only one common fuel line which is returned from all injectors 40 to the reservoir or fuel tank 34. Finally, the method of using dual porting within the injector 40 to very quickly relieve the pressure within the nozzle provides for an abrupt termination of injection while slowly depressurizing the fluid in each respective injection line 44.

Reference is now made to FIGS. 3 and 4 which illustrate one of the pressure activated fuel injectors 40 which has heretofor been shown schematically in FIG. 2. Where possible, the numerals utilized to illustrate the features of the invention shown in the schematic diagram of FIG. 2 will be used in the detailed description of the injector. More specifically, there is shown a pressure activated fuel injector 250 having an external housing (unnumbered) which comprises the following members: a head 252, a hollow sleeve 254, a spring retainer 256 and a nozzle housing 258 which is adapted to receive the nozzle 194. Upon assembly of the injector components 252–258 and 194 each injector 250 is inserted within the engine. The engine is adapted to receive a hollow jacket or sleeve 260. The sleeve 260 is press fit within a corresponding bore within the engine block. The sleeve 260 comprises a substantially hollow member having a stepped bore which comports with the step-like dimensions of the exterior of the injector 250 therein permitting a form fit therebetween. The sleeve 260 is preferrably fabricated from a metal or other material having good thermal transfer characteristics. The sleeve aids in the thermal transfer between the injector 250 and the engine. The sleeve 260 further includes an end 262 having an opening 264 therein to permit the extension of the nozzle 194 therethrough. A washer-like sealing ring or spacer 266 interposes the nozzle housing 258 and the end 262 to provide a seal between the sleeve 260 and the nozzle 194 to prevent combustion gases in the respective combustion chambers of the engine from exiting therefrom.

The following discussion relates to a more detailed description of those components comprising the injector 250. More specifically, the head 252 is a cup-shaped member having an end 270 that is adapted to connect with one of the injection lines 44; in the preferred embodiment, a threaded connection 272 is utilized. The head 252 also contains a circumferential wall 274 having located therein an output passage 276 that is adapted to be connected to a particular one of the accumulator lines 46. An inner portion of the circumferential wall 274 is adapted to engage the hollow sleeve 254 at the threaded connection 278 therebetween. The sleeve 254 is further adapted to receive a resilient seal such as the O-ring 280 to affect a seal between the outer edge of the sleeve 254 and the inner portions of the circumferential wall 274. The sleeve 254 further comprises a step-like bore including a larger bore 282 which terminates in a narrower opening 284. The transition surface between the bore 282 and the opening 284 the forming a shoulder 286.

A multipiece piston retainer 290 is received within the inner cylindrical wall or bore 282 of the sleeve 254. The piston retainer 290 comprises an upper member 292 and a lower member 294. The upper member 292 is a substantially hollow cylinder having fabricated therein the fluid passage 222. Upon assembly, the fluid passage 222 is maintained in fluid communication with the output passage 276. In addition, the upper member 292 further includes a bore 296 which is sized to slidably receive the upper piston member 172.

Upon assembly, the upper member 292 is maintained in a spaced apart relationship relative to the end 270 by a hollowed end cap 298. The end cap 298 includes a shoulder 300 which is located between a narrow bore 302 and a wider bore 304. Both of the bores 302 and 304 are maintained in fluid communication with a particular one of the injection lines 44. An upper surface 306 of the end cap is adapted to receive a sealing member such as the O-ring 308 which creates a seal between the end cap 298 and the respective mating surfaces of the end 270 of the head 252.

Reference is now made to the lower member 294 which contains in its upper end an annular recess 310 which is adapted to be in fluid communication with the passage 222. In addition, the annular recess 310 comprises a portion of the middle chamber 184. The lower member 294 further includes a stepped central bore having a first bore 312 and a second wider bore 314 which is located proximate the lower end of the second member 294. The diameter of the first bore 312 is sized to slidably receive the lower piston member 174 and the second bore 314 may be positioned within the lower member 294 such that its upper extreme is below the lower surface 188 of the piston 170 when the piston is in its uppermost position of travel. As can be seen from FIG. 3, the second bore substantially corresponds the metering chamber 186 which has been schematically illustrated in FIG. 2. The lower member 294 further includes an extension of fluid passage 222 which is illustrated as 222' which intersects the annular recess 310 and extends through its entire length. The lower member 294 further includes the fluid passage 206 which extends upwards from its lower end. The fluid passage 206 is maintained in fluid communication with the second bore 314 through a metering port 196 and in communication with the first bore 312 through the secondary dump port 208. The location of the secondary dump port 208 within the first bore 312 is chosen in conjunction with the size of various portions of the piston 170.

Reference is now made to the piston 170 which is slidably received within the piston retainer 290 and more specifically within the upper and lower members 292 and 294 respectively. As previously mentioned, the piston 170 comprises a cylindrical upper member 172 and a narrower cylindrical lower member 174. The upper member 172 contains a central fluid passage 214 having situated therein the laminar flow restrictor 216. The laminar flow restrictor 216 is secured within the fluid passage 214 by a hollow retaining nut 320 having a central passage 322 therein. In this manner, fuel can be received from a particular injection line 44, communicated through bore 302, passage 322 and to the laminar flow restrictor 216. The lower portion of the fluid passage 214 terminates at the transverse fluid passages 218 and 218'. When the piston 170 is at its upper extremes of travel fluid flow through passages 218 and 218' is prohibited due to the interaction with the closely fitted bore 296.

The narrower cylindrical lower member 174 of the piston 170 comprises a first section 326 having a cross-sectional area comporting with the cross-sectional area of bore 312 and a second narrower section or portion 328. The lower piston member 174 is attached to the upper piston member 172 by the cooperation of a protruding element 330 which extends from the upper piston member 174 into a bore 332 located within the second narrower portion 328 of the lower member 174. A pin 334 secures the protruding member 330 to the lower member 174.

Reference is briefly made to FIG. 4 which is a partial sectional view of the injector 250 depicting the piston 170 at its lower extreme of travel. In this position, the secondary dump port 208 is maintained in fluid communication with the annular recess 314 by virtue of the sizing of the narrower second section 328 of the lower member 174. In this manner when the pistion 170 is at its lower extreme of travel, fluid within passage 206 may be vented to the output passage 276. In this position the transition surface 340 between the wider first section 326 and the narrower second section 328 of the lower piston member 174, is situated just below the upper extreme of the secondary dump port 208. In this position fluid can flow from the fluid passage 206 through the secondary dump port 208 through the fluid passage formed between the bore 312 and the narrower second section 328 into the recess 310 and to the output passage 276 via the fluid passage 222. It should be noted that the fluid passage formed between the inner surface of bore 312 and the outer surface of the second section 326 of the lower piston member operates as the fluid passage 210 which was schematically illustrated in FIG. 2.

In addition, as previously mentioned, conjunction with the discussion of FIG. 2, the downward motion of the piston 170 also places the fluid passage 218 (and 218') in communication with the primary dump port 220 thus relieving the pressure in the upper chamber 180 and upstream fluid passages. As illustrated in FIGS. 3 and 4 the primary dump 220 port includes the recess 310 as well as the transition between the narrower bore 296 of the upper member 292 and the wider diameter of the recess 310. This transistion may be referred to as a dump edge 221. As can be seen in FIG. 4 when the piston 170 is substantially at its lower extreme of travel, the lower edge of passage 218 passes the dump surface and is thereby placed in communication with the middle chamber 184 or recess 310 therein providing the primary dumping to the accumulator 50 for fluid within the fluid passage 214. That is, fuel within passage 214 can flow through fluid passages 218 and 218' through the annular recess 310 and to the output passage 276 via the intermediary fluid passage 222.

Reference is again made to FIG. 3. There is shown a spacer 350 interposing the lower member 294 and the spring retainer 256. The spacer 350 is fabricated having a central opening 352 which is located in fluid communication with the metering chamber 186. The spacer 350 further includes two additional passages 354 and 356 which upon fabrication comprise extensions of the fluid passages 206 and 222. In addition the spacer contains thereon a radially offset recess 358 which connects the metering chamber 186 to the fluid passage 206. The recess 358 is the equivalent to the orifice 204 which was schematically illustrated and discussed in conjunction with FIG. 2.

Reference is now made to the spring retainer 256 which comprises a stepped central bore comprising a first bore 360 located within the lower portions of the spring retainer which is adapted to receive a plunger spring 362 and a hollow spring spacers 364. The plunger spring is adapted to receive, at its end opposite the spring spacer, a plunger seat 366. The upper end of the spring retainer 256 has situated therein a check valve 190 which comprises a spring 370 and a ball 372 which is adapted to rest upon and seal a seat 374 which is fabricated as part of the retainer 256. The spring retainer further includes a fluid passage 376 which is a further extension of the fluid passage 222. The fluid passage 376 allows the metering chamber to be filled with fluid from the accumulator 50 through passages 276, 222, 222', 354, 376, 360, through the check valve 190 and bore 186.

The needle spacer 380 further includes an opening 382 which is adapted to receive a portion 384 of the needle 386 which extends therethrough and seats within the needle seat 366. The needle spacer 380 further includes an offset passage 388 which is maintained in alignment with and comprises an extension of the fluid passage 378.

Reference is now made to the nozzle housing 258 which houses the nozzle 194 and includes a centrally located bore 390 which is sized to loosely receive the needle 386. The bore 390 terminates in a plurality of injection orifices 392. The bore 390 is maintained in fluid communication with passage 388 via the fluid passage 394. The nozzle 194 further provides a needle seat 396 which coacts with corresponding surfaces on the needle 386 to terminate flow through the bore 390 to the injection orifices 392.

The operation of the fuel injector depicted in FIGS. 3 and 4 is identical to the operation of the injector that was schematically illustrated in FIG. 2, consequently, the operation of the injector will not be discussed in detail. Suffice it to say that the quantity of fuel to be injected into the engine is first metered or premetered to the metering chamber 186 through the output passage 278, the intermediate passages 222, 222', the middle chamber 184, the bore 360 of the spring jacket, the check valve 190. As the metering chamber is filled, the piston 170 will be forced to move upward. In response to control signals supplied to the timing valve 58, a fluid pulse is generated and introduced into the upper cavity 180, which forces the piston 170 down, which thereupon compresses and pressurizes the fuel within the metering chamber 186 and fluid passages 206, 378, 394 and bore 390. When the pressure force developed arising from the interaction of the pressurized fluid within the bore 390 and the needle 386 exceeds the spring bias force holding the plunger in a closed position, the needle will be caused to move vertically upward therein opening the orifices 392 located within the nozzle 194. Injection is terminated by the interaction of the piston 170 with the primary and secondary dump ports 220 and 208.

Reference is now made to FIGS. 5 through 14, which illustrate the details of the dual solenoid distributor pump 30 which has been schematically illustrated and described in conjunction with the discussion of FIG. 2. Reference is made to FIGS. 5-9 which illustrate a bottom, a top and various cross-sectional views of the assembled distributor pump 30. The distributor pump 30 comprises a multi-part housing including the drive housing 402, the distributor housing 404 and the accumulator valve housing 406. The injection pump 130 is sandwiched between housing sections 402 and 404 which are bolted together by the set of screws 410. The accumulator valve housing 406 is separated from the transfer pump housing by the transfer pump 102 and is attached to the transfer pump housing by the screws 414. The drive housing 402 and the distributor housing 404 are maintained in radial alignment by the locating pins 416 and screws 418*a–f*. These pins are more clearly illustrated in FIG. 8. The accumulator housing 406 is similarly maintained in axial alignment relative to the transfer pump by the locating pins or dowels 422*a* and *b*. These pins are shown in the cut-away sections in FIG. 9.

Figure 7:
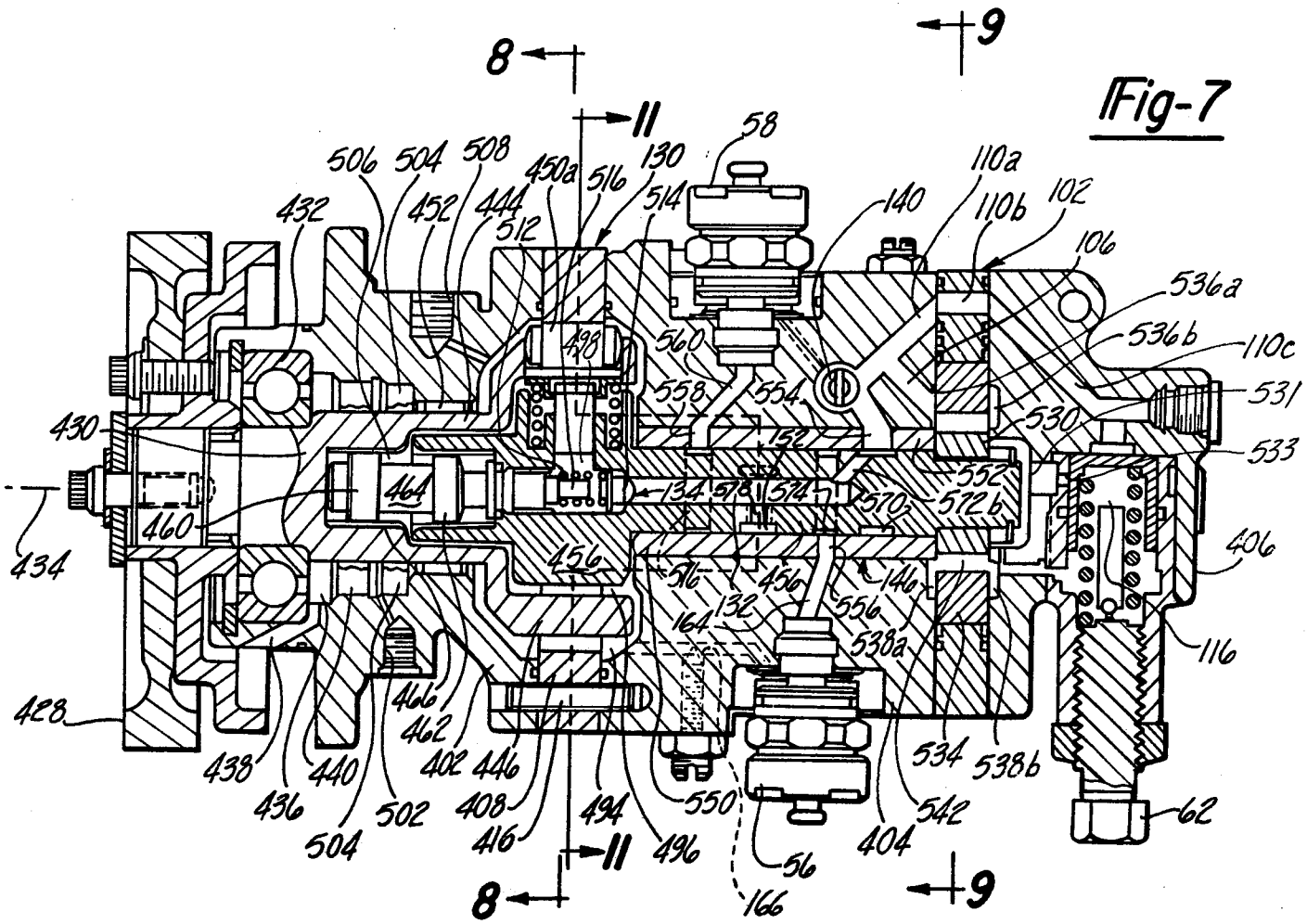
FIG. 7 is a cross-sectional view taken through section 7—7 of FIG. 6.

Reference is now made to the left hand portion of FIG. 7. There is shown a driving gear 428. Upon mounting the distributor pump 30 to a diesel engine, the driving gear 428 is adapted to engage a mating gear of the engine. The driving gear provides the motive force to propel the injection pump 130 and the transfer pump 102. Alternatively, the driving gear 428 can be replaced with a pulley and belt, however, for high torque applications the driving gear is preferred. The driving gear is attached, in a known manner, to a drive shaft 430. The drive shaft is mounted within and rotates relative to the ball bearings 432. Lubricating oil is supplied to the cavity 436 for lubricating the drive shaft and ball bearing 432 through the fluid passage 438. The end of the fluid passage 438 is visable in FIG. 5. The end of the fluid passage 438 may be adapted to connect with a source of lubricating oil in a known manner. A seal 440 isolates the lubricating oil from other parts of the distributor pump.

The drive shaft 430 is a substantially cup-shaped member having an middle cylindrical portion 444 which is connected to a cylindrical flange 446. The cylindrical flange is mounted concentric with the central axis 434 of the injection pump 130 and houses a set of roller bearings 450*a, b* and *c*. These roller bearings are more clearly illustrated in FIG. 8. The middle cylindrical portion 444 of the drive shaft is supported relative to the injection pump housing 402 by the needle bearings 452.

The drive shaft 430 is drivingly coupled to the distributor shaft 456 which is coaxially situated relative to the central axis 434. Since it is desirable to isolate the distributor shaft from bending motions of the drive shaft 430. The distributor shaft 456 is not directly driven by the drive shaft 430. The distributor shaft is drivingly coupled to the cylindrical portion 444 of the drive shaft 430 through the splines 460, 462 and the shaft 464. The spline 462 is situated within a recessed portion 466 of the distributor shaft.

It can be seen from FIG. 7 that the left hand portion of the distributor shaft comprises an integral part of the injection pump 130 and that the right hand portion of the distributor shaft supports and drives the transfer pump 102. The intermediate portion of the distributor shaft between the injection pump and the transfer pump comprises an integral part of the distributor valve 146.

Figure 8:
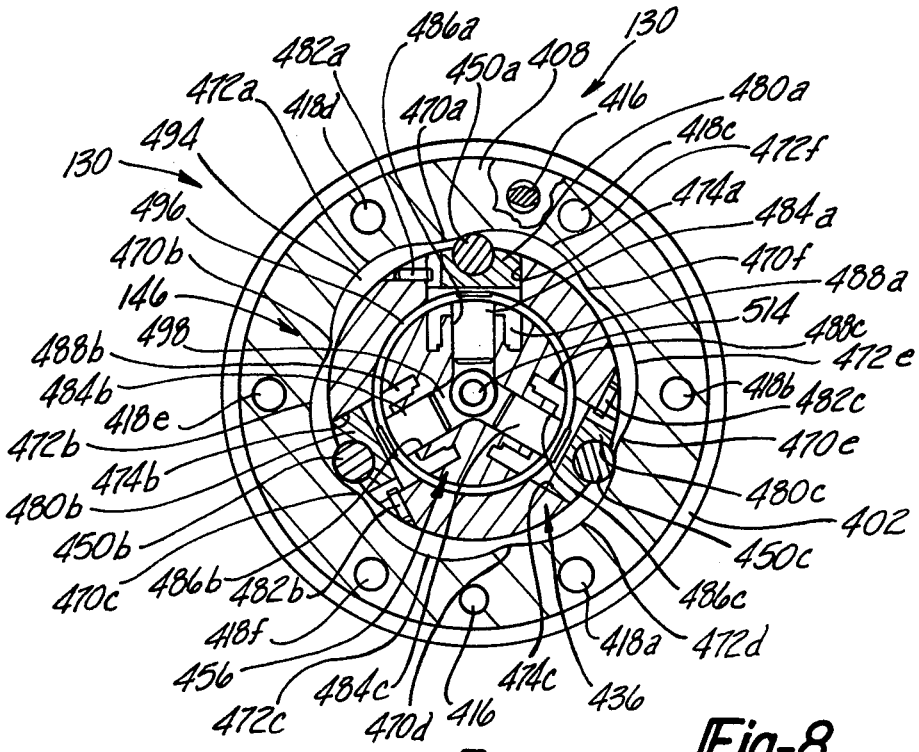
FIG. 8 is a cross-sectional view of the injection pump taken through section 8—8 of FIG. 7.

Reference is now made to FIGS. 7 and 8 which illustrate the main features of the injection pump 130. The injection pump comprises the cam 408 which is illustrated in FIG. 8 as having six alternating lobes comprising the six land areas and six recess areas 470*a–f* and 472*a–f*, respectively. The number of lands 470 and corresponding recesses 472 are chosen based on the number of injectors to be driven by the distribution pump and the number of pumping pistons 488. The shaping of the lands and recesses and the transitions therebetween, determine the injection characteristics of the injection pump 130 and will be discussed in conjunction with FIG. 16. The injection pump 130 further comprises a first rotating member which is the cylindrical flange 446 of the drive shaft 430. The cylindrical flange has fabricated therein a plurality of bores 474*a–c*. The centes of these bores are situated at equal angular spacing from each other. Consequently, when integrated within a distributor pump 30 which is designed to supply fuel to six injectors, these bores are located one hundred and twenty degrees (120°) from one another. The injection pump 130 further includes three cam followers such as the previously mentioned roller bearings 450*a–c*. Each cam follower or roller bearing 450 is mounted within a shoe 480*a–c*, each of which in turn is reciprocally mounted within one of the three bores 474*a–c*. Each of the shoes 480*a–c* is prevented from rotating by a shoe pin 482*a–c*. The lower portion of each of the shoes 480 contacts a piston 484*a–c*, respectively. The pistons are slidably received within bores 486*a–c* which are fabricated within a portion of the distributor shaft 456.

In operation, the distributor shaft 456 and drive shaft 430 rotate together causing the roller bearings 450*a–c* to follow the lands and recesses of the cam 408, thus causing each shoe 480*a–c* to move radially inward and outward. This reciprocating motion is transmitted to the pistons 484*a–c* which move with reciprocating action within their appropriate bores 486*a–c*. The motion of each piston compresses the fluid within the pumping chamber 498, i.e., the lower portion of the bores 486 causing the fluid therein to exit therefrom through passage 490 shown in FIGS. 12 which is located proximate the check valve 134. As can be seen from FIG. 8, the land areas 470 of the cam force the piston in an inward direction. As the roller bearings 450 contact the recess areas 472 of the cam, the fluid pressure within the pumping chamber 498 will cause each piston 484 to move radially outward. If, however, the pressure of the fluid within the pumping chamber 498 is not sufficient to move the piston outward and constant roller and cam contact is desired, then a spring may be inserted between the distributor shaft 456 and each shoe 480 therein biasing the roller bearings 450*a–c* against the surfaces of the cam 408.

Reference is now made to the volume 494 in FIG. 7 located between the outer surface of the drive shaft 430 and the cam 408 and the volume 496 between the inner surface of the drive shaft 430 and the outer surface of the distributor shaft 456. In operation, the roller bearings will usually be in contact with the cam surface causing the pistons to reciprocally move within their respective bores. Consequently, to prolong the life of the injection 130 pump it is desirable to continuously lubricate these moving parts. This is achieved by filling the volumes 494 and 496 with a lubricating fluid.

In the embodiment of the distributor pump illustrated in FIG. 7, it has been chosen to lubricate the moving parts of the injection pump with diesel fuel, however lubricating oil can be used if desired. As illustrated in FIG. 7, fuel oil is used to lubricate the cam 146, roller 450, shoes 480, spline 464 and the needle bearing 452. The source of this fuel oil is the by-pass flow from the accumulator 116 to the passage 531. There are four axial passages through the distributor housing 404 which connects volume 531 to volume 494 which is the volume where the cam 146, rollers 450, shoes 480, spline adapter 464 and needle bearing 452 are bathed in diesel fuel for lubrication. The lubricating diesel fuel is returned to the reservoir or tank 34 via the output port 508. Seal 504, in FIG. 7, is used to isolate the diesel fuel from the lubricating oil used for the ball bearings 432. A vent 502 is used to drain leakage between the two seals 436 and 502.

Reference is again made to the injection pump 130 and more specifically to the centrally located check valve 134. As illustrated in FIG. 7, the check valve comprises spring 512 and poppet 514. The spring 512 biases the poppet 514 to close one end of the fluid passage 132 which is situated within the distributor shaft 456. A mechanical stop for the poppet 514 is provided by the stop 516 which is located on the central axis 434 and within the lower extremes of the pumping chamber 498. The connections between the pumping chamber 498 and the distributor valve 146 is discussed in conjunction with FIG. 12.

Figure 9:
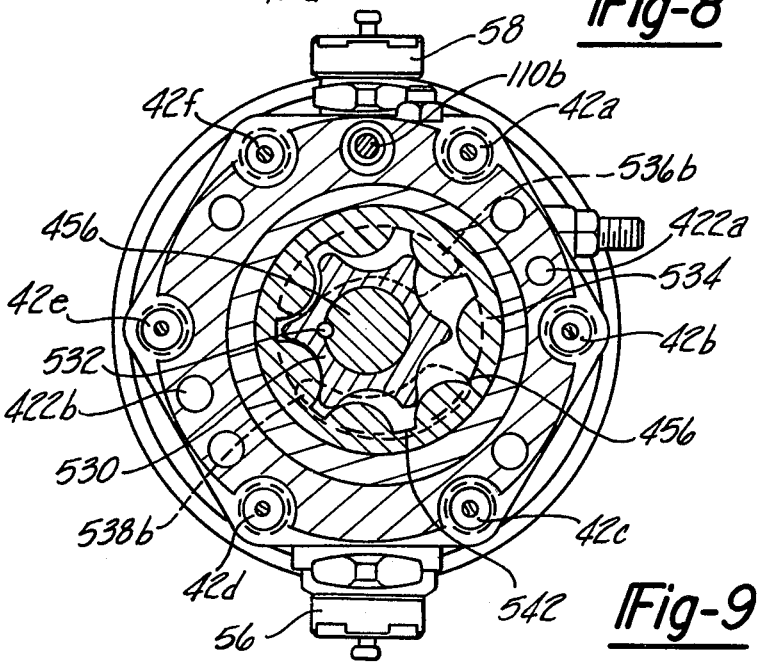
FIG. 9 is a cross-sectional view of the transfer pump taken through sections 9—9 of FIG. 7.

Reference is now made to the right hand portion of FIG. 7 and more specifically to the elements of the transfer pump 102 as illustrated in FIGS. 7 and 9 and to the interconnectings between the transfer pump 102 and the accumulator 116.

The transfer pump 102 may be a conventional pump such as a gerotor. The transfer pump includes the right hand portion of the distributor shaft 456 which is attached to a inner gear 530. The inner gear is axially centered relative to the central axis 434. A pin or key mechanism 532 secures the inner gear 530 to the distributor shaft 456. An outer gear 534 is eccentrically positioned relative to the axis 434 and spaced apart from the inner gear 530. The transfer pump 102 further includes two sets of kidney shaped slots 536*a, b* and 538*a, b*. The kidney shaped slots 536*a* and 538*a* are fabricated in the distributor housing 404 while the slots 536*b* and 538*b* are fabricated in the accumulator valve housing 406.

Fuel is received by the distributor pump 30 at its input port 38 (see FIG. 10) and transmitted through internal flow passages to the kidney shaped slot 538*b*. This received fluid is maintained at substantially the pressure of the reservoir or fuel tank 34. This fluid will fill both the kidney slots 538*a* and *b* as well as the volume 542 which links the slots 538*a* and *b*. The quantity of fluid or fuel which is now trapped within the volume 542 will be compressed as the distributor shaft 456 causes the inner gear 530 to rotate relative to the outer gear 534. This action of the driving gear 530 compressing the fluid relative to the outer outer gear 534 will cause the compressed fluid to exit from the transfer pump 102 at an elevated pressure via the slot 536*a*. The fluid passage 106 as shown in FIG. 7 connected to the kidney shape is equivalent to the fluid passage 106 schematically illustrated in FIG. 2. The output of the transfer pump 102 is also communicated via the fluid passages 106, 110*a, b* and *c* to the accumulator 116 which functions to regulate the output pressure of the transfer pump 102. The accumulator 116 further includes a relief valve which dumps the excess fluid not required to fill the injection pump. By having the top edge of the accumulator piston 535 uncover the dump slot 533 the fluid then flows into valve 531 through the four passages in the distributor housing to lubricate the cam, roller shoe, as discussed earlier, and then exits through the port 508 and return to the tank 34.

If the relief valve and accumulation wre separate components, two sets of pistons and springs would be required. By using this approach only one spring and piston is required to control the supply pressure. The output of the transfer pump 102 is also communicated to the check valve 134 located within the injection pump 130 via the fluid passage 132 which is located within a portion of the idstributor shaft 456.

Reference is again made to the distributor shaft 456, in particular, that portion of the distributor shaft which is situated between the transfer pump 102 and the injection pump 130. The distributor shaft is slidably secured by transfer pump 102 and rotatably secured within the housing sections 402 and 404 by the sleeve 550. It will be seen that the combination of the sleeve and the distributor shaft 456 comprise the distributor valve 140 which was schematically illustrated and discussed in conjunction with the description of FIG. 2.

Figure 11:
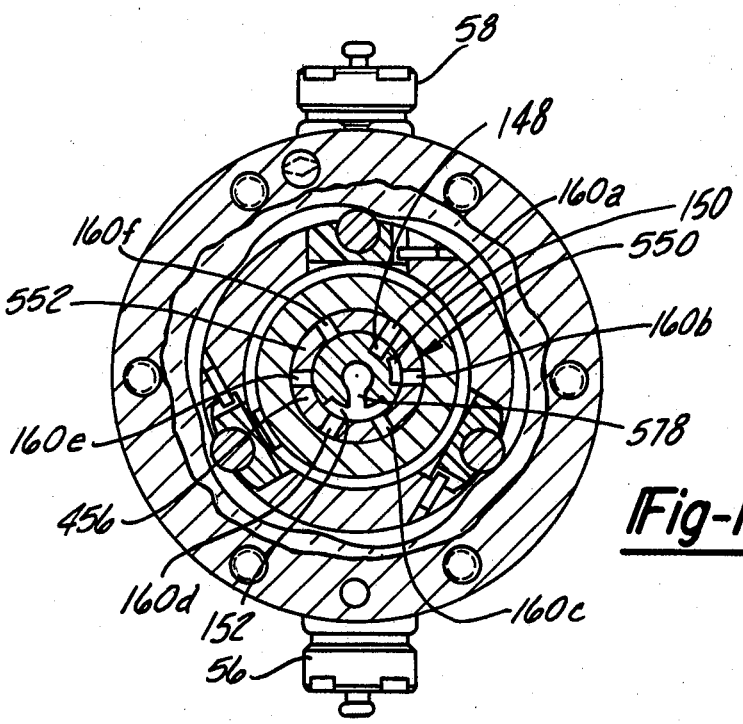
FIG. 11 is a partial sectional view taken through section 11—11 of FIG. 7.
Figure 10:
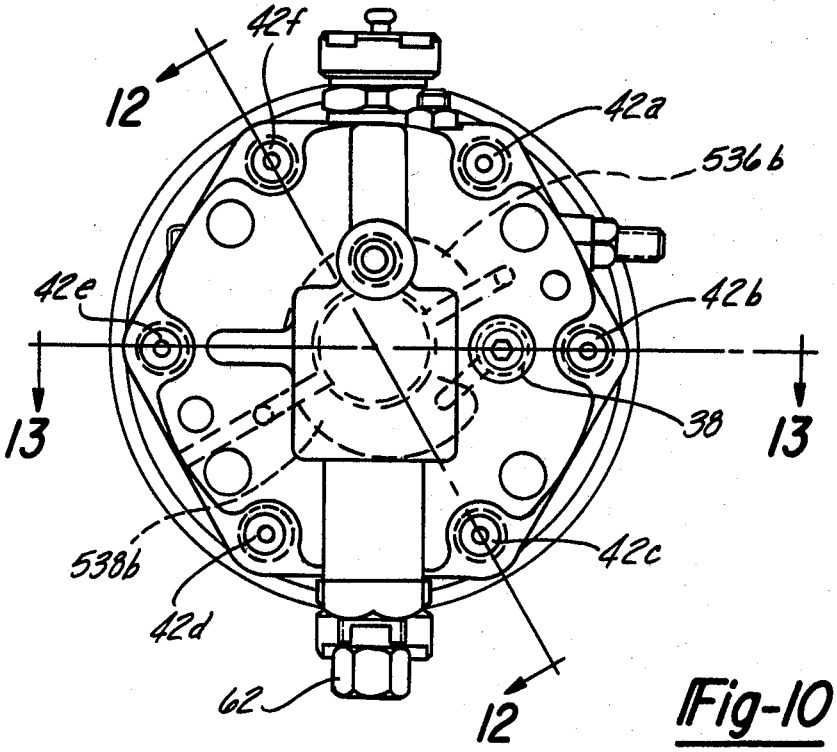
FIG. 10 is an end view of the distributor pump showing its input and output ports.

Reference is now made to FIGS. 7 and 11. FIG. 11 is a partial cross-sectional view through part of the injection pump 130 and the distribution valve 146 illustrating the placement of the distributor shaft 456 and the sleeve 550 in relation to other parts of the injection pump 130. As illustrated in FIG. 7, the sleeve 550 comprises a circular cylinder having a wall 552. The sleeve is press fit within housing section 404 and includes an opening 554 located within the wall 552. As will be seen below, the opening 554 is located in mating engagement with an annular recess 570 that is fabricated within a portion of the distributor shaft 456. In operation, fluid is received from the transfer pump 102 and accumulator 116 and transported through the opening 554 to the annular recess 570. The fluid is then communicated through the fluid passages 572*a, b* and *c* to the central fluid passage 132 which is located within the distributor shaft. In this manner, fluid is supplied from the transfer pump 102 and accumulator to the pumping chamber 498 of the injection pump 130. In addition, the fluid within the fluid passage 132 is communicated via the transverse bore 578 to the distribution slot 152, which as illustrated in FIGS. 7 and 11, and comprises a section of an annular slot communicating with two of the openings, such as openings 160*c* and *d*. In this manner, pressurized fluid from the transfer pump 102 is communicated to particular injectors 40*a–f* through the openings 160*a–f* in advance of the time that the distribution slot 150 is placed in communication with a particular injector 40 through its respective opening 160. While the distribution slot 152, as illustrated in FIG. 11, is shown communicating with two of the remaining four openings 160*c–f*, the number of openings in communication with the distribution slot 150 may vary with the specific application of the invention and the characteristics of the transfer pump 102. The sleeve 550 further includes another opening 556 which is maintained in alignment with the fluid passage 164 which is connected to the metering valve 56. The opening 556 is located so that it is in alignment with another annular recess 574 which is fabricated within the pump shaft 456. The annular recess 574 comprises part of the distribution slot 150 which was discussed in conjunction with FIG. 2. The sleeve 550 further contains another opening 558 which is connected to the timing valve 58 through the fluid passage 560. The opening 558 is maintained in fluid communication with another annular recess 576 that is fabricated within the pump shaft. The annular recess 576 comprises a portion of the distribution slot 148 which was similarly discussed in conjunction with FIG. 2.

Figure 12:
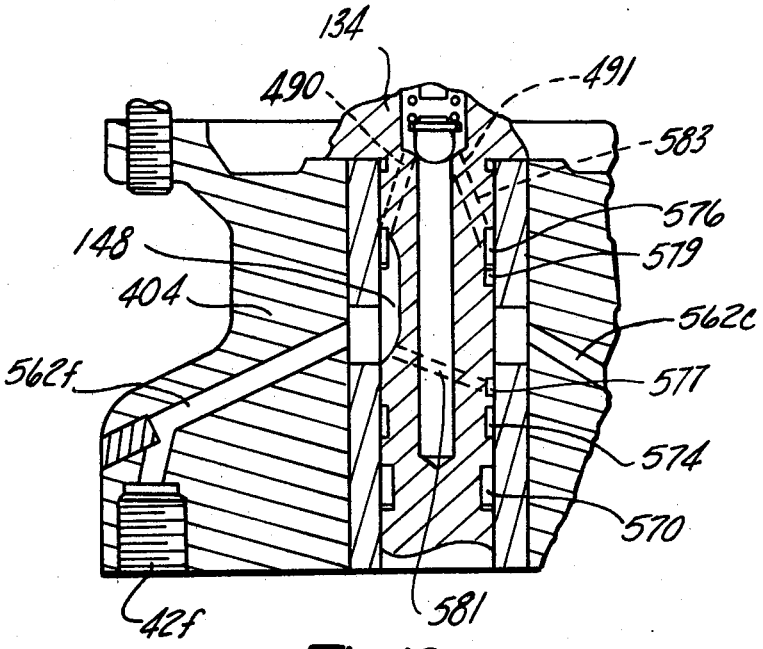
FIG. 12 is a partial sectional view taken through section 12—12 of FIG. 10.
Figure 13:
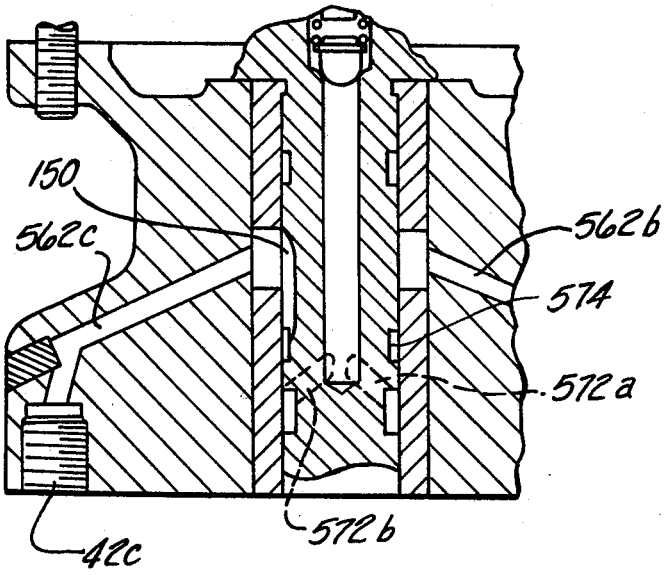
FIG. 13 is a partial sectional view taken through section 13—13 of FIG. 10.

The sleeve 550 further includes another opening 556 which is maintained in alignment with the fluid passage 164 which is connected to the metering valve 56. The opening 556 is located so that it is in alignment with another annular recess 574 which is fabricated within the distributor shaft 456. The annular recess 574 comprises part of the distribution slot 150 which was discussed in conjunction with FIG. 2. The sleeve 550 further contains another opening 558 which is connected to the timing valve 58 through the fluid passage 560. The opening 558 is maintained in fluid communication with another annular recess 576 that is fabricated within the distributor shaft. The annular recess 576 comprises a portion of the distribution slot 148 which was similarly discussed in conjunction with FIG. 2. The sleeve 550 further includes a plurality of circumferentially and symmetrically situated openings 160*a–f*. It should be recalled that the function of these openings 160*a–f* is to permit the selective communication between the distribution pump 30 and the injectors 40*a–f*. As previously discussed, these openings are connected via fluid passages to a plurality of output ports 42*a–f* which are located about the periphery of the distributor pump. The means by which these openings are communicated to their respective output port is illustrated in FIG. 12. FIG. 12 is a partial sectional view of the distributor valve 146 and more specifically a partial sectional view of the sleeve 550 and the distributor shaft 456 taken through section 12—12 of FIG. 10. There is illustrated one of the six fluid passages 562*a–f* linking the timing slot 150 with the output ports 42*a–f*. FIG. 13 also illustrates the porting of the metering slot 150 to another output port such as output port 42*c*.

Figure 14:
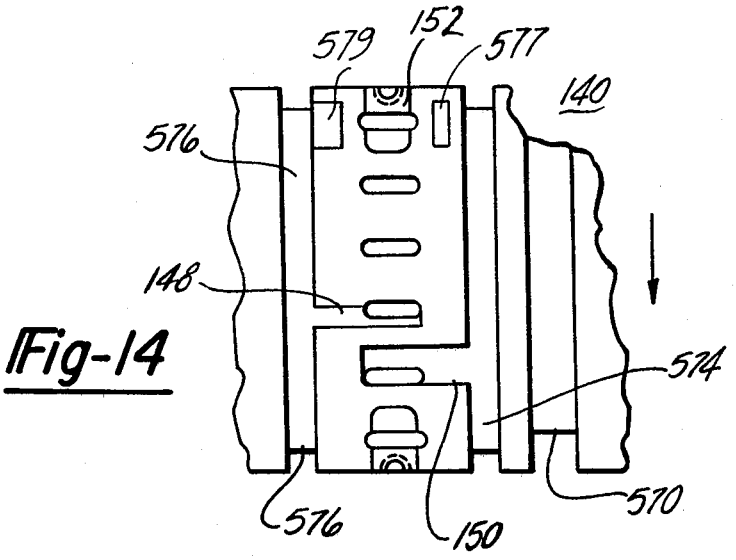
FIG. 14 is a linear projection of the distributor valve shown in FIG. 7.

The pressure balance slots 577 and 579 shown in FIGS. 12 and 14 are used to counteract the high unbalanced force on the distributor shaft 456 by the high pressure from the injection pump in slot 148. This is to ensure low wear and long life of the distributor shaft 456 rotating in the sleeve 550. Passage 581 and 583 connect the slots 577 and 579, respectively, to the high pressure in slot 148. The areas of slots 577 plus 579 equals the area of slot 148 and are 180° apart thereby pressure balancing the shaft.

To permit the selective communication of fluid from the distributor valve 146 to the respective output ports 42*a–f*, it is necessary to selectively distribute the fluid or fuel within the annular recesses 574 and 576 of the distributor shaft 456 to the openings 160*a–f*. This is accomplished as illustrated in FIGS. 12 and 13 by providing the annular recess 576 with a timing groove 148 and by providing the annular recess 150 with a metering groove 582 which corresponds to the schematic in FIG. 2. The relationship of the timing groove 580 and the metering groove 582 to their respective annular recesses 574 and 576 is illustrated in FIG. 14. It should first be appreciated that both the piston shaft 456 and the sleeve 550 are circular objects. FIG. 14, however, represents a linear projection of the various portions of the distributor valve 146. For reference purposes, it should be appreciated that the linear projection of the distributor valve illustrated in FIG. 14 is substantially identical to the schematic diagram illustrated in FIG. 2. As illustrated in FIG. 14, the timing groove axially extends parallel to the axis 434 such that it envelopes the entire length of each of the openings 160*a–f*. Additionally, the width of the timing groove 148 is chosen to be substantially equal to the width of the openings 160*a–f*. The metering groove 582 similarly extends axially parallel to the axis 434 and similarly extends to a length sufficient to cover each of the openings, however, the width of the metering is preferably but not necessarily chosen to be substantially larger than that of the openings. By way of example, in the preferred embodiment, the dimensions of the openings are 3.91 mm by 12.7 mm (0.154 inches by 0.5 inches). The total area of the openings can be shown to approximately be 46.7 $mm^2$ (0.072 square inches). The width of the metering groove 150 has been chosen to be equal to 8.26 mm (0.325 inches). As the distributor shaft 456 rotates within the sleeve 550, the flow areas between the respective grooves 148, 150 of the openings 160*a –f* will change. Flow area is defined as the overlapping area between a particular opening and the timing groove or the metering groove. The arrow illustrated in FIG. 14 shows the direction of shaft motion. As previously mentioned, the metering groove will interact with each opening in advance of the time that the timing groove will interact with the same opening.

Figure 15A:
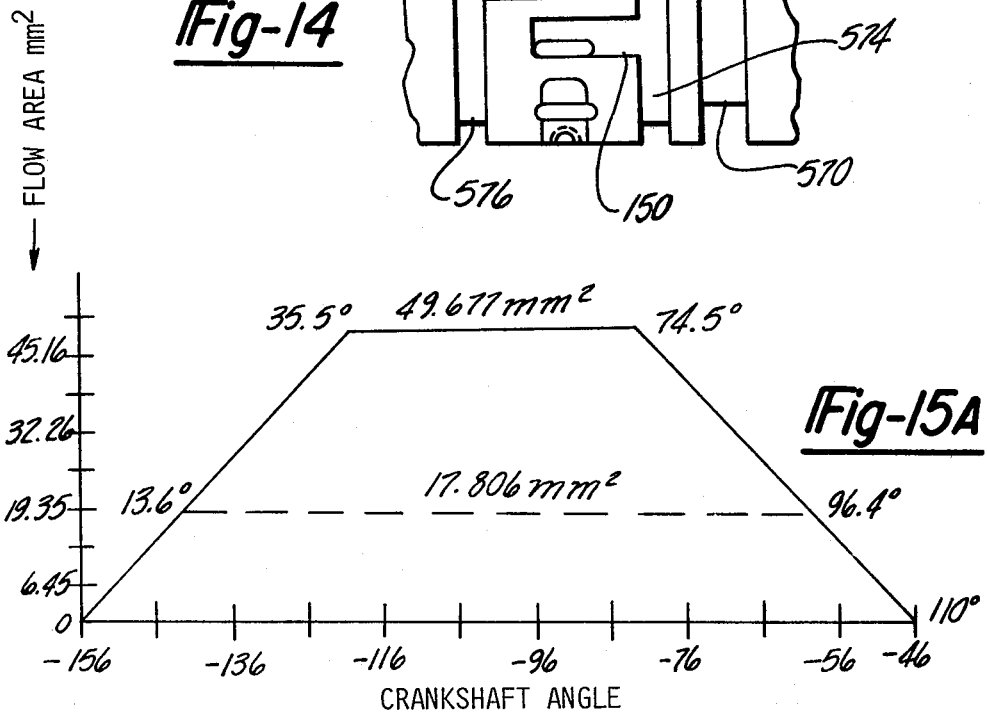
FIGS. 15A–B graphically, illustrate the flow area of the distributor valve.

Reference is briefly made to FIGS. 15A and B which illustrate the flow area versus crank shaft angle which may be achieved by utilizing a distribution valve 146 having openings 160, the timing groove 148, and the metering groove 150 as discussed above. It should be recalled that the flow area represents the overlapping or intercepting areas of any of the openings 160*a–f* with the timing groove 148 and metering groove 150.

FIG. 15A illustrates the actual and effective flow area obtained when utilizing the above described distribution valve 146. The actual flow area for the intersection of the metering groove 150 and any of the openings 160 is illustrated by the solid line of FIG. 15A. During the period of time that the timing groove does not intersect the opening 160, the flow area is obviously zero. As the pump shaft rotates the metering groove and an opening 160 will overlap. Due to the shaping of the metering groove 150 and openings 160 the initial increase in the overlaping areas has substantially a linear relationship. The overlaping area or flow area will continue to increase until the smaller opening 160 is totally encompassed by the larger metering groove. For the embodiment of the distributor valve previously discussed, this occurs as approximately 120° before the top dead center position of the respective cylinder. The actual flow area will remain at this level until the metering groove and opening begin to pass one another and their common area will linearly reduce to zero. Those skilled in the art will appreciate that the rate of flow area increase with crank angle may be shaped by varying the geometry of the metering groove and/or openings 160. Those skilled in the art will also appreciate that the area presented to the flow of fluid may not only depend upon the overlapping areas of openings such as 160 and the metering or timing grooves 582 and 580, respectively. As an example, the upstream line restrictions may be smaller than the actual flow area of the distributor valve 146. This narrow area of the fuel flow lines upstream of the distribution valve 146 will effectively limit the flow area of the distribution valve. FIG. 15A illustrates in the dotted line the effective flow area presented by the present invention which is approximately 17.8 $mm^2$ (0.0276 $in.^2$).

Figure 15B:
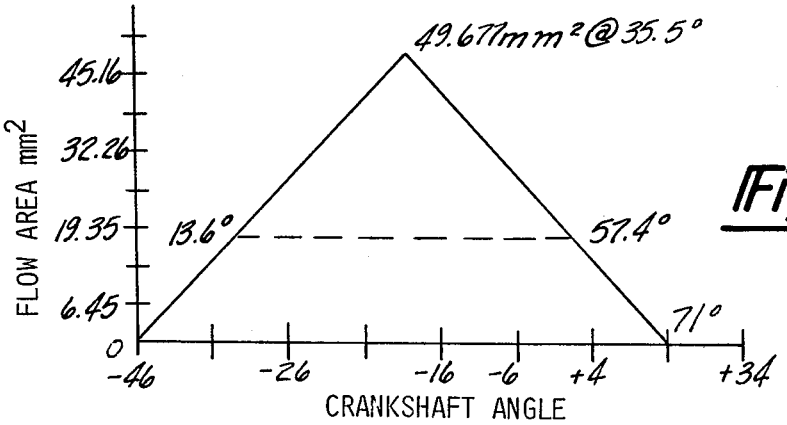

FIG. 15B illustrates the actual and effective flow areas created between one of the openings 160 and the timing groove 148. The characteristic discontinuity in the actual flow area (solid line) is due to the fact that the width of the timing groove 148 is identical that of the openings 160.

Figure 16:
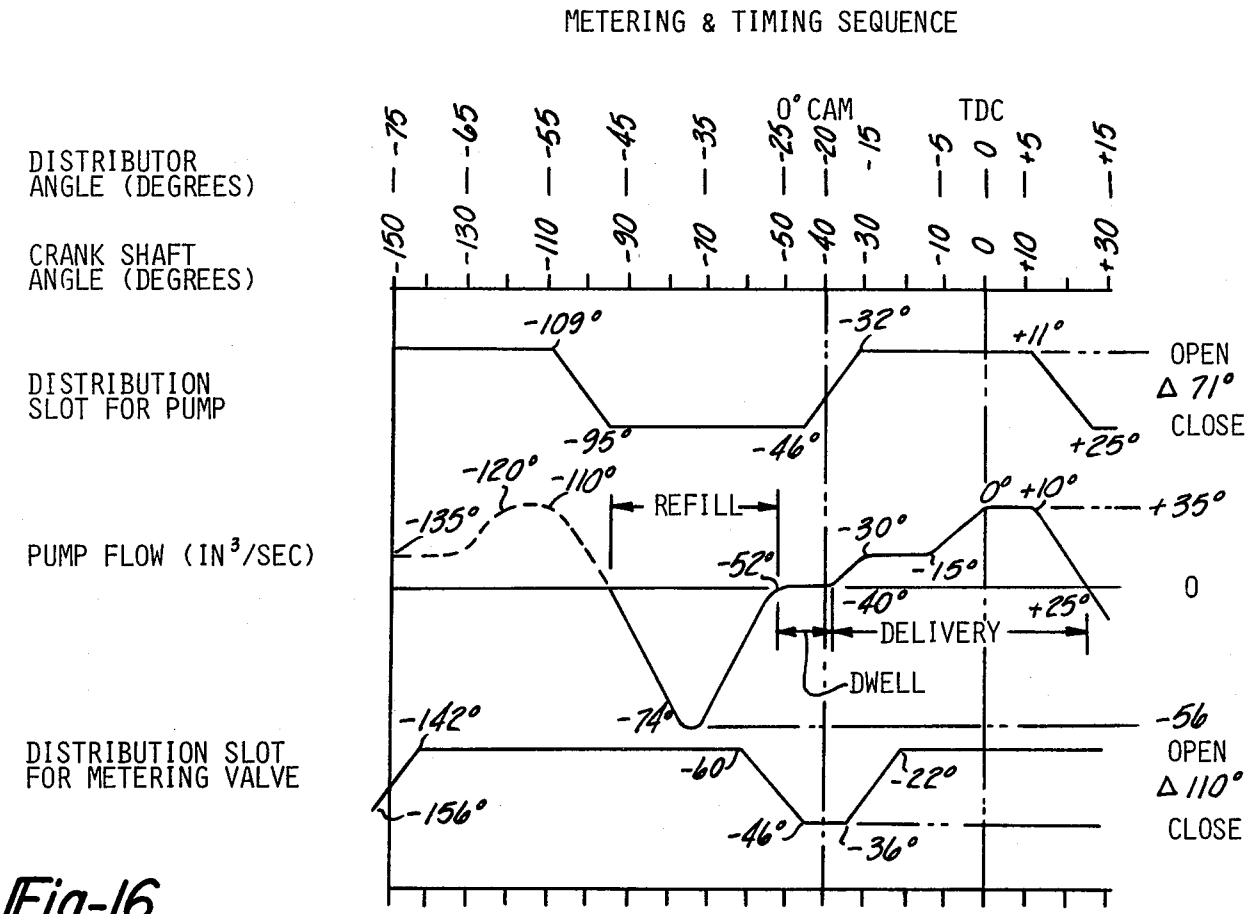
FIG. 16 graphically illustrates a metering and timing sequence.

Reference is made to FIG. 16 which illustrates a typical metering and timing sequence generated by the dual solenoid distributor pump 30. Reference is made to lines 1 and 2 of FIG. 16. It should be recalled that the shaft of the distributor pump engine typically rotates at a speed which is one half that of the engine crankshaft. This relationship is illustrated in lines 1 and 2 of FIG. 16. In addition, lines 1 and 2 are helpful in identifying the top dead center or 0° position line for the engine piston movement and for locating the 0° cam position of the injection pump 130 which in the preferred embodiment of the invention is located 40° in advance of the top dead center position and indicates that position of the crankshaft when the injection pump 130 will begin to deliver pressurized fuel. Reference is made to line 4 of FIG. 16 which illustrates the three intervals of injection pump 130 operation. These include refill, dwell and delivery portions. During the refill interval or cycle the transfer pump 102 and the accumulator 116 supplies additional fuel to the injection pump 130. This refill cycle is initated during that interval of time when the timing slot 148 does not coincide with any of the openings 160*a–f*. The refill portion of the pump cycle is followed by a dwell cycle which lasts approximately 12° in duration. The dwell cycle is followed by a delivery cycle which continues until the timing slot is no longer in coincidence with an opening 160. Lines 3 and 5 of FIG. 16 illustrate the effective flow areas for the injection and metering functions performed by the dual solenoid distributor pump 30. As illustrated in FIG. 16 initiation of flow area for the metering function proceeds that of the initiation of flow area for the injection function.

Many changes and modifications in the above-described embodiment of the invention can, of course, be carried out without departing from the scope thereof. Accordingly, that scope is intended to be limited only by the scope of the appended claims.

Having thus described the invention, what is claimed is:

1. A fuel injection system for a diesel engine having an injector and metering modes of operation for delivering fuel from a fuel reservoir to the cylinders of a engine comprising:

a plurality of fuel injectors wherein each of said fuel injectors comprise:

a housing having a first port (45) adapted to receive fuel at a first determinable pressure level, a second port (47) adapted to receive fuel at a second determinable pressure level and a nozzle (194), and further having metering chamber means (186) connected to said second port, for storing a premetered quantity of fuel, during the metering mode of operation, prior to the injection of said premetered quantity of fuel into the engine during the injection mode of operation;

piston means (170) responsive to the differential fuel pressure applied thereacross having a first pressure receiving surface (176) in fluid communication with said first port and a second pressure receiving surface (188) in fluid communication with said second port for reciprocatively moving within said housing or selectively compressing and for causing said premetered quantity of fuel to exit said metering chamber means and to be injected into said engine, through said nozzle, during the injection mode and for selectively permitting fuel to reenter said metering chamber means during a subsequent metering mode;

manifold means for connecting in fluid communication each of second ports of each of said fuel injector;

pressure regulating means connected between said manifold means and the fuel reservoir for regulating and for supplying fuel at said second determinable pressure to said second inlet port of each of said injectors and for returning to the reservoir excess fuel received from said injectors;

distributor pump means connected to the said first port of each of said fuel injectors and to the fuel reservoir for sequentially pressurizing said first port of a particular fuel injector at a pressure greater than the pressure established by said pressure regulating means causing said piston to stabilize at the bottom of its stoke and sequentially thereafter lowering said first pressure level to a pressure lower than that of the pressure established by said pressure regulating means thereby causing said piston to move causing said premetered quantity of fuel to enter said metering chamber means of a particular one of said fuel injectors through said second port and for sequentially thereafter increasing said first pressure level thereby causing said piston to pressurize the fuel within said metering chamber means to initiate fuel injection into the engine through said nozzle.

2. The system as defined in claim 1 wherein said fuel injector includes a laminar flow restrictor means for creating a linear relationship between the velocity of fuel flow and the pressure differential thereacross and situated upstream of said metering chamber.

3. The system as defined in claim 2 wherein said distributor pump means, includes a plurality of output ports (42) wherein each output port is connected to a particular one of said first ports of each said fuel injector via a bidirectional injection line (44) and further having a pump inlet port (38) adapted to receive fuel from the fuel reservoir and an outlet port (64) adapted to return fluid to the reservoir, for selectively lowering said first pressure level applied to each said fuel injector in timed relation to the combustion process within the engine and thereafter for selectively increasing said first pressure level, comprising:

first pressure source means (130) for supplying pressurized fluid, at a determinable first pressure level;

timing valve means (58) for directing the output of said first pressure source means to a distributor valve means during the injection mode of operation and for directing the output of said first pressure source means to said return port during the metering mode of operation, said timing valve means adapted to receive electrical signals in timed relationship to the combustion process within the engine;

distribution valve means for receiving fluid under pressure from said first pressure source means including first distributor means (148, 160) for sequentially connecting said first pressure source means to a particular one of said output ports (42) in timed sequence with the operation of said timing valve means and with the combustion process within the engine, said distributor valve means further including second distributor means (150) for sequentially connecting said each of said output ports to said metering valve means for a determinable length of time prior to the time said particular one of said output ports is connected to said first pressure source means, and third distribution means (152) for sequentially connecting each said particular output ports to determinable pressure source in advance of the time that each said particular output port is connected to said return port by said second distribution means.

4. The system as defined in claim 3 wherein said distributor pump means further includes:

metering valve means (56) connected between said distributor valve means and said return port for controlling the duration of fluid flow from a particular one of said injectors through said distributor valve means to said return port in correspondence with the combustion process within said engine and wherein said metering valve means is adapted to receive electrical signals in timed sequence to the combustion process within the engine.

5. The system as defined in claim 4 wherein said piston means is an intensifier piston wherein the area of said first pressure receiving surface is less than the area of said second receiving surface.

6. The system as defined in claim 5 further including first orifice means (166) located between said metering valve means and said return port for regulating the rate at which fluid flows from said distributor valve means to said return port.

7. The system as defined in claim 6 further including second orifice means (140) connected between said timing valve means and said return port for determining the pressure upstream of said timing valve means during periods of operation when said timing valve means is open.

8. The system as defined in claims 6 or 7 wherein said metering valve means is normally closed and wherein said timing valve means is normally open.

9. The system as defined in claim 8 further including a second pressure source means (102, 166) adapted to receive fluid from the reservoir for delivering the received fluid at a second pressure level to said first pressure source means and wherein the second pressure level is less than or equal to the first pressure level.

10. The system as defined in claim 9 further including check valve means (134) for selectively permitting fluid flow from said second pressure source means to said first pressure source means.

11. The system as recited in claim 10 wherein said second pressure source means is located within said housing.

12. The system as defined in claim 11 wherein said second pressure source means comprises a transfer pump means for extracting fluid from said reservoir and pressure regulating means connected to the output of said transfer pump means and said return port, for regulating the output pressure of said transfer pump means at said second pressure level.

13. The system as defined in claim 12 wherein said second orifice means is connected between said timing valve and the second pressure source means.

14. The system as defined in claim 13 wherein said distributor valve means includes:

a stationary cylindrical sleeve having a plurality of openings located therein and situated about the circumference of said sleeve, wherein each of said openings is connected to a respective one of said output ports;

a shaft rotatably received within said sleeve in a fluid-tight engagement therewith and wherein driving means connected to said shaft for driving said shaft; and wherein said first, second and third distribution means comprise fluid carrying passages fabricated in said shaft that are selectively connected to particular ones of said openings in correspondence with the combustion process in an engine as said shaft rotates within said sleeve.

15. The system as defined in claim 14 wherein said first distribution means comprises a first fluid passage including:

a first annular recess situated about the periphery of said shaft and the inner mating walls of said sleeve; and timing slot means situated about the periphery of said shaft for connecting, in cooperation with the rotation of said shaft, said first annular recess to one of said openings and wherein said second distribution means comprises a second fluid passage isolated from said first fluid passage and said openings formed by a second annular recess within said shaft and a cooperating section of the inner surface of said wall of said sleeve and metering slot means for sequentially connecting in correspondence with the rotation of said shaft, said second annular recess to said particular opening prior to the time that said timing slot means is connected to said particular opening and wherein said third distribution means comprises a third fluid passage, isolated from said first fluid passage, said second fluid passage and said openings, formed by a partial annular slot on said shaft and a cooperating section of the inner surface of said wall of said sleeve, and a pressure bore situated within said shaft having a first end in fluid communication with said slot; and wherein said slot is situated on said shaft such that it is sequentially placed in communication with said particular opening prior to the time that said metering slot means is connected to said particular opening.

16. The system as defined in claim 15 wherein said laminar flow restrictor is situated within said piston.

17. A distributor pump having a metering and an injection mode of operation and adapted to receive electric control signals from a controller (60) and further adapted to receive fluid from a fluid reservoir (34) for supplying pressurized fluid comprising:

a housing (402, 404, 406) having a return port (64) adapted to be connected to the reservoir (34), an input port (38) adapted to receive fluid from the reservoir and further having a plurality of output ports (42);

first pressure source means for supplying pressurized fluid at a determinable first pressure level;

timing valve means for diverting the output of said first pressure source means to a distributor valve means during the injection mode of operation and for diverting the output of said first pressure source means to said return port during the metering mode of operation, said timing valve means adapted to receive electrical signals in timed relationship to the combustion process within the engine;

metering valve means (56) connected between said distributor valve means and said return port for controlling the duration of fluid flow from said distributor valve means to said return port during the metering made in correspondence with the combustion process within said engine and wherein said metering valve means is adapted to receive electrical signals in timed sequence to the combustion process within the engine; and distributor valve means for receiving fluid under pressure from said first pressure source means including first distributor means (148, 160) for sequentially connecting said first pressure source means to a particular one of said output ports (42) in timed sequence with the operation of said timing valve means and with the combustion process within the engine, said distributor valve means further including second distributor means (150) for sequentially connecting said each of said output ports to said metering valve means for a determinable length of time prior to the time said particular one of said output ports is connected to said first pressure source means, and third distribution means (152) for sequentially connecting each said particular output ports to determinable pressure source in advance of the time that each said particular output port is connected to said return port by said second distribution means.

18. The distributor pump as defined in claim 17 further including first orifice means (166) located between said metering valve means and said return port for regulating the rate at which fluid flows from said distributor valve means to said return port.

19. The distributor pump as defined in claim 18 further including second orifice means (140) connected between said timing valve means and said return port for determining the pressure upstream of said timing valve means during periods of operation when said timing valve means is open.

20. The distributor pump as defined in claims 18 or 19 wherein said metering valve means is normally closed and wherein said timing valve means is normally open.

21. The distributor pump as defined in claim 20 further including a second pressure source means (102, 166) adapted to receive fluid from the reservoir and for delivering the received fluid at a second pressure level to said first pressure source means and wherein the second pressure level is less than or equal to the first pressure level.

22. The distributor pump as defined in claim 21 further including check valve means (134) for selectively permitting fluid flow from said second pressure source means to said first pressure source means.

23. The distributor pump as recited in claim 22 wherein said second pressure source means is located within said housing.

24. The distributor pump as defined in claim 23 wherein said second pressure source means comprises a transfer pump means for extracting fluid from said reservoir and pressure regulating means connected to the output of said transfer pump means and said return port, for regulating the output pressure of said transfer pump means at said second pressure level.

25. The distributor pump as defined in claim 24 wherein said second orifice means is connected between said timing valve and the second pressure source means.

26. The distributor pump as defined in claim 25 wherein said distributor valve means includes:

a stationary cylindrical sleeve having a plurality of openings located therein and situated about the circumference of said sleeve, wherein each of said openings is connected to a respective one of said output ports;

a shaft rotatably received within said sleeve in a fluid-tight engagement therewith and wherein driving means connected to said shaft for driving said shaft; and wherein said first, second and third distribution means comprise fluid carrying passages fabricated in said shaft that are selectively connected to particular ones of said openings in correspondence with the combustion process in an engine as said shaft rotates within said sleeve.

27. The distributor pump as defined in claim 26 wherein said first distribution means comprises a first fluid passage including:

a first annular recess situated about the periphery of said shaft and the inner mating walls of said sleeve;

timing slot means situated about the periphery of said shaft for connecting, in cooperation with the rotation of said shaft, said first annular recess to one of said openings;

said second distribution means comprises a second fluid passage isolated from said first fluid passage and said openings formed by a second annular recess within said shaft and a cooperating section of the inner surface of said wall of said sleeve and metering slot means estimated within said shaft for sequentially connecting in correspondence with the rotation of said shaft, said second annular recess to said particular opening prior to the time that said timing slot means is connected to said particular opening; and wherein said third distribution means comprises a third fluid passage, isolated from said first fluid passage, and second fluid passage and said openings, formed by a partial annular slot on said shaft and a cooperating section of the inner surface of said wall of said sleeve, and a pressure bore situated within said shaft having a first end in fluid communication with said slot and wherein; said slot is situated on said shaft such that it is sequentially placed in communication with said particular opening prior to the time that said metering slot means is connected to said particular opening.

* * * * *